US006120026A

United States Patent [19]

Whitney et al.

[11] Patent Number: 6,120,026

[45] Date of Patent: Sep. 19, 2000

[54] GAME WITH PRIVACY MATERIAL

[75] Inventors: Leland R. Whitney, St. Paul; Myron K. Jordan, Eagan; Thomas J. Scanlan; Gregory D. Allen, both of Woodbury, all of Minn.

[73] Assignee: 3M Innovative Properties Co., St. Paul, Minn.

[21] Appl. No.: 09/006,327

[22] Filed: Jan. 13, 1998

[51] Int. Cl.[7] ..... A63F 3/00

[52] U.S. Cl. ..... 273/236; 273/287

[58] Field of Search ..... 273/237, 262, 273/265, 269, 272, 273, 274, 287, 148 R, 309, 150, 151, 148 A, 157 A

[56] References Cited

U.S. PATENT DOCUMENTS

| | | | |
|---|---|---|---|
| 540,768 | 6/1895 | Western . | |
| 1,475,430 | 11/1923 | Curwen . | |
| 3,124,639 | 3/1964 | Kahn | 88/65 |
| 3,610,729 | 10/1971 | Rogers | 350/157 |

(List continued on next page.)

FOREIGN PATENT DOCUMENTS

| | | | |
|---|---|---|---|
| 7-108084 | 4/1995 | Japan | A63F 7/02 |
| 8-19639 | 1/1996 | Japan | A63F 7/02 |
| 8-164245 | 6/1996 | Japan . | |
| WO 95/27919 | 4/1995 | WIPO | G02B 27/28 |
| WO 95/17303 | 6/1995 | WIPO | B32B 7/02 |
| WO 95/17691 | 6/1995 | WIPO | G02B 5/30 |
| WO 95/17692 | 6/1995 | WIPO | G02B 5/30 |
| WO 95/17699 | 6/1995 | WIPO | G02F 1/1335 |
| WO 96/19347 | 6/1996 | WIPO | B32B 7/02 |
| WO 97/01440 | 1/1997 | WIPO | B32B 27/36 |
| WO 97/01774 | 1/1997 | WIPO | G02B 33/22 |
| WO 97/07653 | 2/1997 | WIPO . | |
| WO 97/32226 | 9/1997 | WIPO | G02B 5/30 |

OTHER PUBLICATIONS

Durel 3 Electroluminescent System, Durel Product Brochure, 26 pages, 1995.

Invicta Plastics (USA) Limited, Instructions for "Super Master Mind", 200 5th Avenue, New York, NY 1972.

Milton Bradley Co., Instructions for "Battleship", 1990, 1996.

Quantex product information from Internet website, "http://www.u.s.net/quantex/el.htm", Jul. 10, 1997, 10 pages.

Schrenk et al., Nanolayer polymeric optical films, Tappi Journal, pp. 169–174, Jun., 1992.

Selchow & Righter Co., Rules for Playing Scrabble Brand Crossword Game, Copyright 1948, 1949, 1953, 1976.

Letter from Engelhard Corporation dated Apr. 11, 1997.

Mearl Corporation Product Information entitled "Mearl Iridescent Films, General Information", Sheet No. TIB–C, 6 pages, at least Apr. 11, 1997.

Mearl corporation Product Information entitled "Mearl Standard Iridescent Films, Product Comparison Charts, Applications, and Properties", 4 pages, Oct. 1992.

ChromaFlair® Light Interference Pigments Product Brochure, Flex Products, Inc., at least 1997.

ChromaFlair® Light Interference Pigments Product Brochure Packet (consisting of a folder with an 8 page insert, and a 6 page document entitled Commonly Asked Questions (Apr. 1997) and a seventh page entitled ChromaFlair® Preliminary Technical Data Sheet (Apr. 1997),, at least 1997.

(List continued on next page.)

*Primary Examiner*—William M. Pierce
*Attorney, Agent, or Firm*—Gregory D. Allen

[57] ABSTRACT

Game with a privacy member. The game includes a play region and a directional viewing screen. The directional viewing screen covers at least a portion of the play region such that said portion of the play region is viewable therethrough at a first player position, but is not viewable therethrough at a second player position. The game with privacy member in accordance with the present invention allows for enhancement of existing games, as well as for the creation of new games or new play patterns of existing games.

28 Claims, 8 Drawing Sheets

U.S. PATENT DOCUMENTS

| | | | |
|---|---|---|---|
| 3,711,176 | 1/1973 | Alfrey, Jr. et al. | 350/1 |
| 3,860,036 | 1/1975 | Newman, Jr. | 138/45 |
| 4,066,925 | 1/1978 | Dickson | 313/503 |
| 4,138,620 | 2/1979 | Dickson | 313/1 |
| 4,146,229 | 3/1979 | Morse | 273/150 |
| 4,205,846 | 6/1980 | Levine | 273/310 |
| 4,232,864 | 11/1980 | Yaworsky | 273/241 |
| 4,356,429 | 10/1982 | Tang | 313/503 |
| 4,421,313 | 12/1983 | Chang | 273/237 |
| 4,446,305 | 5/1984 | Rogers et al. | 528/348 |
| 4,520,189 | 5/1985 | Rogers et al. | 528/331 |
| 4,521,588 | 6/1985 | Rogers et al. | 528/363 |
| 4,525,413 | 6/1985 | Rogers et al. | 428/212 |
| 4,720,426 | 1/1988 | Englert et al. | 428/344 |
| 4,780,643 | 10/1988 | Ellis et al. | 313/503 |
| 5,147,716 | 9/1992 | Bellus | 428/323 |
| 5,156,885 | 10/1992 | Budd | 427/70 |
| 5,165,781 | 11/1992 | Orak | 362/186 |
| 5,188,760 | 2/1993 | Hikmet et al. | 252/299.01 |
| 5,211,878 | 5/1993 | Reiffenrath et al. | 252/299.63 |
| 5,235,443 | 8/1993 | Barnik et al. | 359/37 |
| 5,247,190 | 9/1993 | Friend et al. | 257/40 |
| 5,254,388 | 10/1993 | Melby et al. | 428/120 |
| 5,269,995 | 12/1993 | Ramanathan et al. | 264/171 |
| 5,294,657 | 3/1994 | Melendy et al. | 524/270 |
| 5,316,703 | 5/1994 | Schrenk | 264/1.3 |
| 5,319,478 | 6/1994 | Fijnfschilling et al | 359/53 |
| 5,337,224 | 8/1994 | Field et al. | 362/84 |
| 5,389,324 | 2/1995 | Lewis et al. | 264/171 |
| 5,409,783 | 4/1995 | Tang et al. | 428/690 |
| 5,418,062 | 5/1995 | Budd | 428/403 |
| 5,439,705 | 8/1995 | Budd | 427/212 |
| 5,448,404 | 9/1995 | Schrenk et al. | 359/584 |
| 5,469,019 | 11/1995 | Mori | 313/509 |
| 5,486,935 | 1/1996 | Kalmanash | 359/37 |
| 5,486,949 | 1/1996 | Schrenk et al. | 359/498 |
| 5,491,377 | 2/1996 | Janusauskas | 313/506 |
| 5,508,585 | 4/1996 | Butt | 313/509 |
| 5,554,450 | 9/1996 | Shi et al. | 428/690 |
| 5,593,782 | 1/1997 | Budd | 428/403 |
| 5,598,059 | 1/1997 | Sun et al. | 313/509 |
| 5,612,820 | 3/1997 | Schrenk et al. | 359/498 |
| 5,629,055 | 5/1997 | Revol et al. | 428/1 |
| 5,686,979 | 11/1997 | Weber et al. | 349/96 |
| 5,699,188 | 12/1997 | Gilbert et al. | 359/584 |
| 5,721,603 | 2/1998 | De Vaan et al. | 349/194 |
| 5,744,534 | 4/1998 | Ishiharada et al. | 524/442 |
| 5,751,388 | 5/1998 | Larson | 349/96 |
| 5,767,935 | 6/1998 | Ueda et al. | 349/112 |
| 5,770,306 | 6/1998 | Suzuki et al. | 428/328 |
| 5,783,120 | 7/1998 | Ouderkirk et al. | 264/134 |
| 5,793,456 | 8/1998 | Broer et al. | 349/98 |
| 5,808,794 | 9/1998 | Weber et al. | 359/487 |
| 5,825,542 | 10/1998 | Cobb, Jr. et al. | 359/487 |
| 5,825,543 | 10/1998 | Ouderkirk et al. | 359/494 |
| 5,836,585 | 11/1998 | LaCivita | 273/287 |

OTHER PUBLICATIONS

"3M Optical Systems Application Bulletin/Technical Specification", 75–0500–1433–3–C, Mar. 1997.

"3M Automotive Light Control Systems", brochure, 75–0299–6220–8(29.2)R1, published 1989.

GAME WITH PRIVACY MATERIAL

FIELD OF THE INVENTION

The present invention relates to a game having a privacy play region which can be selectively viewed by one or more players.

BACKGROUND OF THE INVENTION

Games, such as board games or children's games, have long been available as a form of entertainment and test of skill. The types of games are numerous, and range from simple games suitable for young children to highly complicated adult games. Many games include a play region, along with play pieces or other accessories for use by players on the play region. The play region includes a design of some type defining various zones or areas directing movement of the play pieces. Other accessories, such as die or cards, may also be included.

For some games, it is desirable to hide a portion of the play region and/or play pieces from an opposing player(s). In a crossword game, for example, such as that marketed under the trade designation "SCRABBLE", players keep spare letters lined up on a rack, such that opposing or adjacent players may not view their letters. Although points are scored in the crossword game by arranging letters to form words in a two-dimensional fashion, players are limited to storing or arranging letters on their crossword rack in a linear or single dimension.

In some games, a large portion of the play region is hidden from another player(s). For example, in the naval combat game marketed under the trade designation "BATTLESHIP", each player is positioned opposite their opponent with a briefcase-shaped game unit. Each player's game unit is opened to expose an ocean grid and a target grid. The ocean grid is used for "hiding" a player's battleships from the opposing player, and the target grid is used for tracking "hits" and "misses" of an opponent's battleships. Further, the target grid is used for blocking the opponent from seeing an opposing player's ocean grid. With this game setup, game play is limited to two players, and each player must trust that the other player will not move their battleships around once they are placed on the ocean grid.

Other known games, such as that marketed under the trade designation "MASTERMIND", are designed to hide a relatively small portion of the play region from an opposing player's view. In such game, a secret code is hidden by one player from another player.

SUMMARY OF THE INVENTION

The present invention provides a directional viewing member including a privacy screen for use with a game, such that a play region may be selectively viewed by one or more players, and selectively blocked from view by another player located in a different position (e.g., an opposing or adjacent player). The present invention enhances the play pattern for several conventional games. Further, the present invention optionally allows the creation of new games or allows for changing the play pattern of existing games (e.g., allowing two person games to be expanded to allow for three or more players).

In one exemplary embodiment, the present invention provides a game which includes a play region and a directional viewing screen, wherein the directional viewing screen covers at least a portion of the play region such that the portion of the play region is viewable therethrough by a first player, but is not viewable therethrough by a second player, who is located in a different position than the first player. For some games, the second player is typically positioned opposite the first player, and for three or more player games, other players may be adjacent to the first player. In another aspect, the directional viewing screen may be a directional film, and may include multiple layers of film.

A second directional viewing screen may be located adjacent the first directional viewing screen, wherein the second directional viewing screen has a different viewing direction from the first directional viewing screen.

The game may further include a second play region and a second directional viewing screen. The second directional viewing screen covers the second game play region such that the second play region is viewable therethrough by the second player, but is not viewable therethrough by the first player. The second play region may be attached to the first play region, or the second play region may be separate from the first play region (or other play regions). Additionally, the second play region may be separable from the first play region (or other play regions).

The game may further include an additional play region(s) (e.g., a third, fourth, etc. play region) and an additional directional viewing screen(s), wherein the additional directional viewing screen(s) covers the respective additional play region(s) such that such additional play region(s) is viewable therethrough by a respective additional player, but is not viewable therethrough by the other players located in a position different from the respective additional player(s). The third play region may not be viewable by the second player.

The game may further include a third play region and a third directional viewing screen, wherein the third directional viewing screen covers the third play region, such that the third play region is viewable therethrough by a third player, but is not viewable therethrough by the first player or the second player. The directional viewing screen may include printing on at least a portion thereof. In another aspect, the directional viewing screen may include multiple layers of directional film, wherein each layer of directional film includes a viewing direction which is crossed relative to an adjacent layer of the directional film, such that the first game play region is viewable through the multiple layers of directional film in only one direction.

Optionally, one or more game play regions are illuminated, for example, by coupling a power source to a light source. The light source preferably includes an electroluminescent sheet device. The desired play region(s) can be illuminated, for example, by positioning the light source adjacent such play region(s). A switch mechanism may be operably coupled between the power source and the electroluminescent sheet device.

In the present application electroluminescent lamps or devices will be referred to as: An "electroluminescent sheet device", which in contrast to a point light source (including a light emitting diode) has an extended light emitting surface area (i.e., at least 1 $cm^2$, typically at least 2 $cm^2$, at least 5 $cm^2$, or greater) which typically provides uniform light emission from the surface. Typically, such a device has a length and a width that are much greater than its thickness (i.e., at least 10 times; typically at least 25 times, more typically, at least 100 times, greater than the thickness devices).

BRIEF DESCRIPTION OF THE DRAWING

The accompanying drawing is included to provide a further understanding of the present invention and are incorporated in and constitute a part of this specification. The drawing illustrates exemplary embodiments of the present invention and together with the description serve to further explain the principles of the invention. Other aspects of the present invention and many of the attendant advantages of the present invention will be readily appreciated as the same becomes better understood by reference to the following Detailed Description when considered in connection with the accompanying drawing, and wherein.

DETAILED DESCRIPTION

The present invention provides a game comprising a play region and a directional viewing screen. The directional viewing screen covers at least a portion of the play region. The directional viewing screen allows a portion of the play region to be viewed by a first player, but not by a second player.

The present invention allows for the enhancement of game play of several conventional games, and allows for the creation of new games. Further, a game according to the present invention having the directional viewing screen can enhance existing games, and allow for the creation of new games or new play patterns for existing games.

Figure 1:
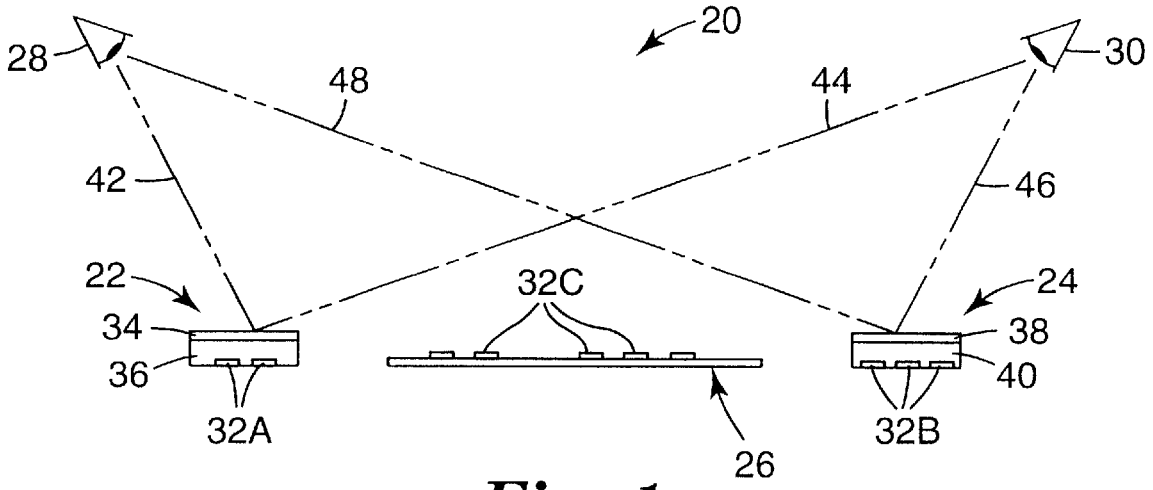
FIG. 1 is a diagram illustrating an exemplary embodiment of a game in accordance with the present invention.

Referring to FIG. 1, which depicts one exemplary embodiment of a game in accordance with the present invention is generally shown. Game 20 includes first directional viewing member 22, second directional viewing member 24, and central game play region 26. First player 28 and second, opposed player 30 are shown in one typical play arrangement.

Game 20 further includes game pieces 32 (indicated as 32A, 32B, and 32C) used for "playing" the game. A pattern to facilitate play may be located on central game play region 26, for example, to direct the movement of play and positioning of game pieces, such as game pieces 32A, 32B, and 32C.

Game pieces 32A are located within first directional viewing member 22, game pieces 32B are located within second directional viewing member 24, and game pieces 32C are located on central game play region 26. First directional viewing member 22 includes first directional viewing screen 34 positioned over first game play region 36. Similarly, second directional viewing member 24 includes second directional viewing screen 38 positioned over second play region 40. In the embodiment shown, first play region 36 and second play region 40 are generally box shaped. First directional viewing member 22 is located adjacent central game play region 26. Second directional viewing member 24 is located adjacent central game play region 26 on a side opposite first directional viewing member 22.

First directional viewing member 22 and first directional viewing screen 34, operate in a transmissive mode to allow a player to view game pieces 32A located on first play region 36 from only one direction. Similarly, second directional viewing screen 38 allows game pieces 32B located on second play region 40 to be viewed from only one direction. As such, first player 28 can view game pieces 32A through first directional viewing screen 34 from a first direction (indicated by optical path 42), but second player 30 cannot view game pieces 32A through the first directional viewing screen 34 from a second direction, indicated by optical path 44.

Similarly, second directional viewing screen 38 allows game pieces 32B to be viewed by second player 30 from a first direction, indicated by optical path 46, but second directional viewing screen 38 blocks game pieces 32B from being seen by first player 28 from a second direction, indicated by optical path 48. Game pieces 32C located on central game play region 26 are viewable by both first player 28 and second player 30.

As shown, second player 30 is located opposite first player 28 (although for some play patterns, second player 30 may be located diagonally from or adjacent to first player 28), but still blocked from viewing game pieces 32A by first directional viewing screen 34. Similarly, first player 28 may be located diagonally from or adjacent second player 30, while second directional viewing screen 38 still blocks first player 28 from viewing game pieces 32B.

Referring to FIGS. 1 and 3, one exemplary embodiment of first directional viewing member 22 is shown. First direction viewing screen 34 is mechanically coupled to frame 49 having first play region 36 located therein. Further, frame 49 includes opening 51 for accessing game pieces 32A located on play region 36. The viewing orientation of first directional viewing screen 34 is depicted by arrow 53.

Figure 3A:
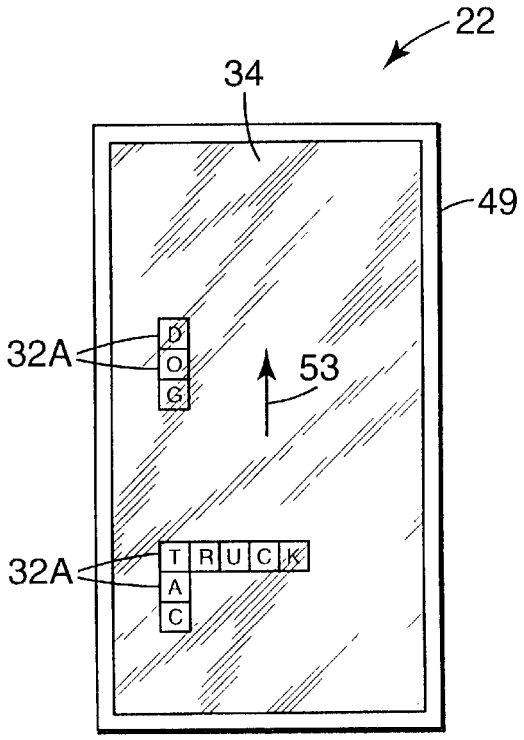
FIG. 3A is a top view of the directional viewing member of FIG. 2, viewed from a first direction.
Figure 3B:
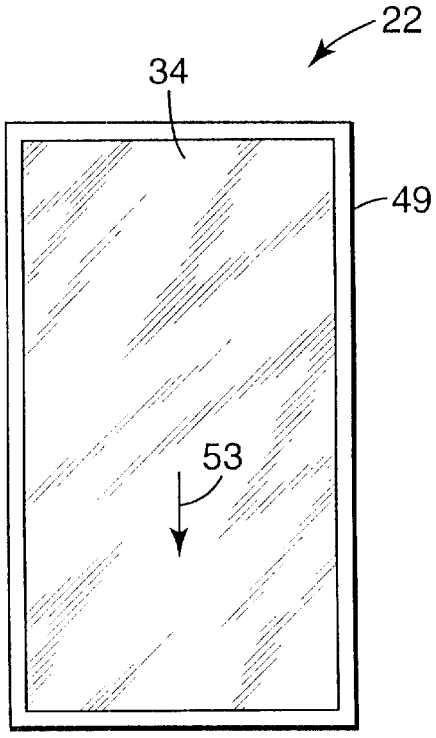
FIG. 3B is a top view of a directional viewing member of FIG. 2, viewed from a second direction.

Referring to FIG. 3A, first directional member 22 is depicted when viewed from a first viewing direction by a first player (as shown in FIG. 1). As such, first directional viewing screen 34 operates in a transmissive mode and game pieces 32A are viewable therethrough. Referring to FIG. 3B, first directional viewing member 22 is shown viewed from a second direction (such as the position of second player 30 shown in FIG. 1). As such, first directional viewing screen 34 operates in a non-transmissive mode and game pieces 32A are not viewable therethrough.

In one embodiment, the directional viewing screen(s) include a directional optical film which optionally is a multi-layer directional optical film polarizer. The polarizer has optical characteristics which operate in a transmissive mode when generally viewed from a first direction, but operates in a non-transmissive mode when viewed from a second direction. The polarizer also has polarizing characteristics.

Suitable polarizers for practicing the present invention include louvered plastic films comprising a plurality of clear regions separated by louvers wherein each of the louvers has a central region having a first coefficient of extinction and an outer region adjacent the clear region having a second coefficient of extinction. Preferably, the first coefficient of extinction is at least 1.5 times the second coefficient of extinction. For additional details regarding louvered plastic film-type polarizers described herein, see U.S. Pat. No. 5,254,388 (Melby et al.), the disclosure of which is incorporated herein by reference.

Suitable (louvered plastic film-type) polarizers for practicing the present invention are also commercially available, for example, under the trade designation "LIGHT CONTROL FILM" from the 3M Company of St. Paul, Minn.

Other polarizers suitable for practicing the present invention may be apparent to those skilled in the art after reviewing the description of the present invention. For example, U.S. Pat. No. 5,147,716 (Bellus) describes a light control film having a sharp cutoff angle comprising a plurality of magnetically alignable aciculae having aspect ratios in the range of 2,500 to 100,000:1 fixedly disposed within a solidified resin matrix, the resin matrix being light transmissive material and thermoplastic or thermoset, the aciculae having their major axes generally aligned in parallel within the matrix. The Bellus patent also describes a multi-directional light control film having a sharp cutoff angle comprising a matrix of generally light transmissive material and a plurality of magnetically alignable aciculae having aspect ratios in the range of 2,500 to 100,000:1 fixedly disposed within the matrix, wherein the film comprises a first region, having aciculae oriented in a generally parallel arrangement with each other and at a first angle to a plane of the film; and a second region having aciculae oriented in a generally parallel arrangement with each other and at a second angle being different from the first angle.

Although, in FIG. 1, directional viewing members are shown separate from a central game play region, in other embodiments according to the present invention the directional viewing members may be employed to be separable from a central game play region. Additionally, the directional viewing members may be attached to or integral to a central game play region.

Figure 4:
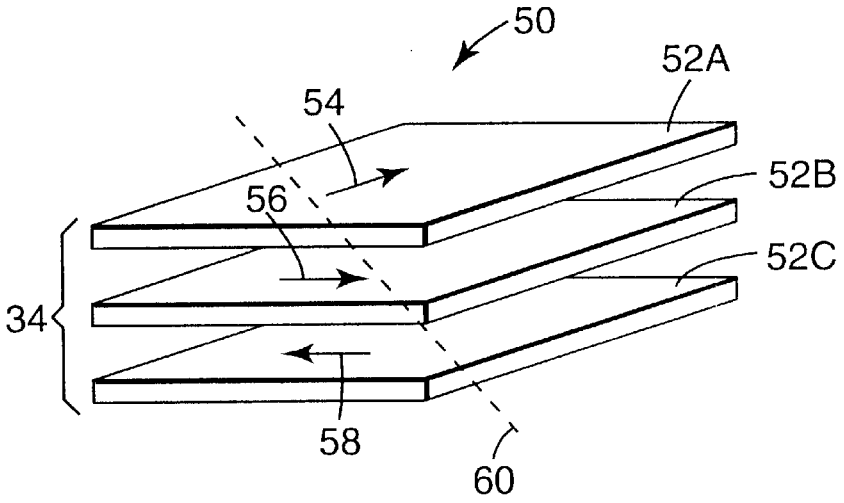
FIG. 4 is an alternative exemplary embodiment of a directional viewing screen in accordance with the present invention.

Referring to FIG. 4, one alternative exemplary embodiment of first directional viewing screen 34 is shown at 50, wherein screen 34 is comprised of multiple layers of directional film, each having a crossed orientation or viewing direction relative to an adjacent directional film. Directional film 52A has first viewing direction 54, directional film 52B second viewing direction 56, and directional film 52C third viewing direction 58. When viewed along optical path 60 first viewing direction 54, directional viewing screen 50 operates in a transmissive mode. When viewed along an optical path, other than an optical path which is approximate optical path 60, directional viewing screen 50 operates in a non-transmissive mode. The arrangement of directional films 52A, 52B, 52C, allows directional viewing screen 50 to exhibit enhanced non-transmissive characteristics for blocking viewing therethrough when viewed along an optical path other than the desired optical path 68. In one embodiment, as a viewer's position approaches optical path 60, directional viewing screen 50 becomes increasingly transmissive.

Figure 5:
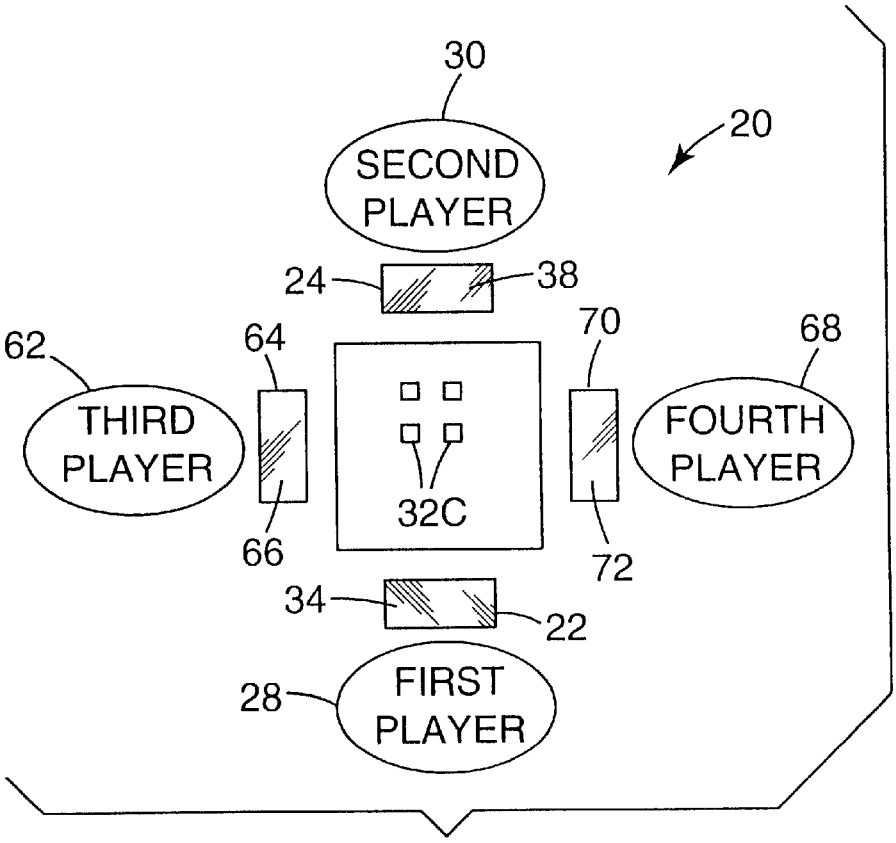
FIG. 5 is a schematic diagram illustrating another exemplary embodiment of a game in accordance with the present invention.

Referring to FIG. 5, it is shown that game according to the present invention 20 is adaptable to games having game play patterns for multiple players, such as two or more players.

Game 20 has third directional viewing member 64 including third directional viewing screen 66 to allow the game to be played by third player 62, and fourth directional viewing member 70 including fourth directional viewing screen 72 to allow the game to be played by fourth player 60. Game pieces located within first directional viewing member 22 can only be viewed from the location of first player 28. Similarly, game pieces located within second directional viewing member 24 are only viewable from the location of second player 30, game pieces located within third directional viewing member 64 are only viewable from the location of third player 62, and game pieces located within fourth directional viewing member 70 are only viewable from the location of fourth player 68.

One preferred game according to the present invention is the crossword board game marketed under the trade designation "SCRABBLE". In the conventional versions of such crossword board game, players form interlocking words crossword fashion on the board using letter tiles of various point values. Players score points by taking advantage of the letter values, as well as by using premium squares on the crossword board.

To begin the game, all letter tiles are turned face down at the side of the crossword board or poured into a bag or another container, and shuffled. Players draw for first play. Each player than draws, for example, seven letters and places them in his or her letter rack. The letter racks are each positioned generally in front of and facing each respective player, adjacent a side of the crossword board.

The first player combines two or more of his or her letters to form a word, and places it on the crossword board to read either across or down with one letter on the center star square. Diagonal words are not permitted. A player completes a turn by counting and announcing the score for the turn. The player then draws as many new letters as played, thus, keeping the same number (e.g., seven) of letters in his or her rack.

Play passes typically to the left with the second player, and then each in turn, adds one or more letters to those already played to form new words. All letters played in a turn are placed in one row across or down the board, to form one complete word. If, at the same time, a letter(s) touches another letter(s) in an adjacent row(s), they must also form complete words, crossword fashion, with all such letters. A player gets full credit for all words formed or modified on his or her turn.

Each player stores seven letters in a linear fashion on their respective letter rack out of view of the other player(s). Although letters are placed on the crossword board in a two-dimensional fashion, letters may only be arranged and stored on the respective letter racks in a linear or single dimension.

Referring to FIGS. 2, 3A, 3B and 5, the present invention enhances crossword game play by allowing each respective player 28, 30, 62, and 68 to store their letters in a two-dimensional fashion. Players may store their letters, forming words in a two-dimensional fashion within their respective directional viewing screen, such as first directional viewing member 22 and/or second directional viewing member 24, out of view of opposing or adjacent players. Further, letter pieces are easily removed from first directional viewing member 22 and/or second directional viewing member 24 for playing or positioning on central game play region 26. Although directional viewing screens in accordance with the present invention enhance game play, crossword may be played using conventional crossword game rules. Alternatively, directional viewing screens may be employed using enhanced or changed crossword games rules.

Another preferred game according to the present invention is a modified version of the naval combat game marketed under the trade designation "BATTLESHIP". Some embodiments of the present invention allow the play pattern of conventional versions of such a game to be changed (e.g., to allow more than two players to play the game).

The rules for the novel combat game marketed under the trade designation "BATTLESHIP" are summarized as follows:

Each player has a generally suitcase shaped game unit and a fleet of five different battleships. The game units are hinged open to expose a generally horizontal ocean grid and a vertical target grid. The game is designed for two players. Opponents sit facing each other, with lids of the game units raised so that neither can see the other's ocean grid (or vertical target grid). Each player secretly places their fleet of five ships onto their respective ocean grid. To place each ship, its two anchoring pegs are fitted into two holes on the ocean grid. A player's opponent does the same. The position of any ship may not be changed once the game has begun.

Game play begins by each player alternating turns, calling out one shot per turn to try and hit each other's ships located on their respective ocean grids. Shots are called by picking a target hole on the upright target grid and calling out its grid location by letter and number. Each target hole has a letter/number coordinate that corresponds with the same coordinate on an opponent's ocean grid. When one player calls a shot, the other player must acknowledge whether the shot is a "hit" or a "miss".

If a player calls out a shot location that is occupied by a ship on the other player's ocean grid, the shot is a hit, and such other player states a ship has been hit. Hits are recorded by placing a red peg in the corresponding target hole on the target grid. The other player places a red peg in the corresponding hole of the ship hit on his or her ocean grid.

If a shot location is called out unoccupied by a ship on the other player's ocean grid, it is a miss. Misses are recorded by placing a white peg in the corresponding target hole on the target grid so that the shot is not called again. It is not necessary for players to record each other's misses with white pegs on their ocean grids. Play continues, with the players alternating turns calling one shot per turn.

Once all of the holes in any ship are filled with red pegs, it has been sunk. A player must announce when one of their ships has been sunk. The first player to sink the other player's entire fleet of five ships wins the game.

The two players face each other with their respective game units open similar to an opened suitcase. As such, the ocean grids for each players having each player's secretly placed fleet of five ships may not be viewed by the opposing players. Although such configuration is functional, each player must be trusted not to move their secretly placed fleet of ships on their corresponding ocean grid once the game has begun. Further, players cannot look past or over each other's opened game units.

Figure 6:
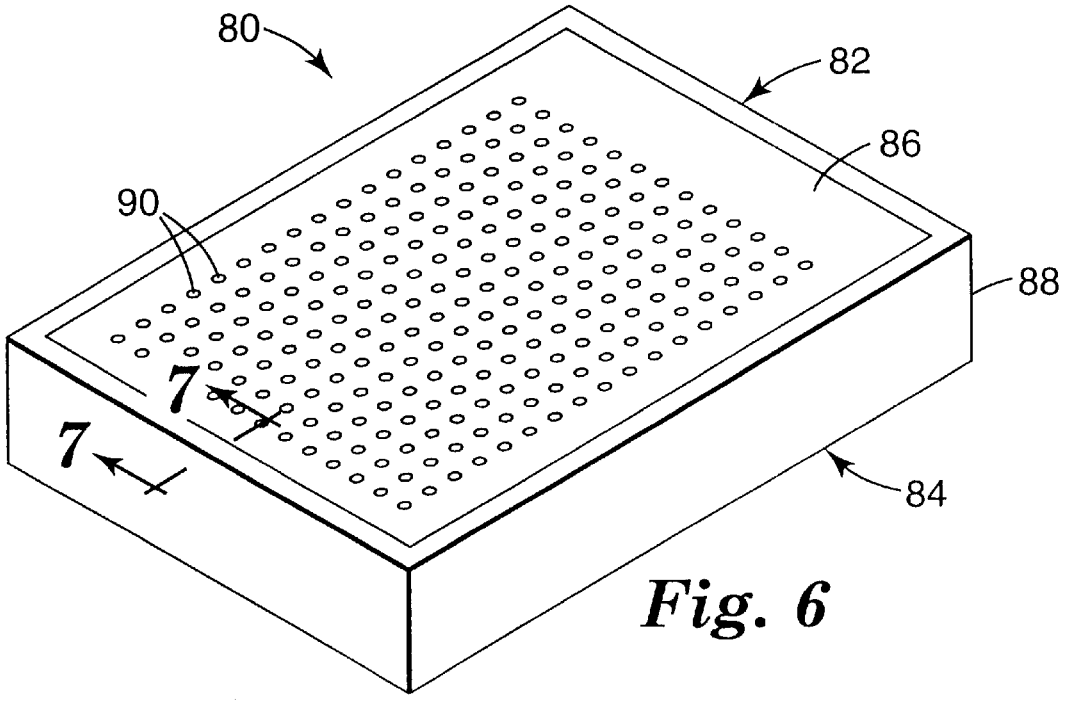
FIG. 6 is a perspective view illustrating an exemplary embodiment of a game unit used in a naval combat game to provide an enhanced game in accordance with the present invention.

A preferred game according to the present invention is an enhanced naval combat game such as that marketed under the trade designation "BATTLESHIP". Referring to FIG. 6, an example of a game unit for such a game is shown. Naval combat game unit 80 allows all players to see each other's target grid, but only allows each player to see their own ocean grid. Game unit 80 includes target grid unit 82 and ocean grid unit 84. Target unit 82 is positioned over ocean unit 84.

Target unit 82 includes grid layer 86 and frame 88. Grid layer 86 is coupled to frame 88 and includes grid holes 90 located therethrough. Target grid 86 is mechanically coupled to target frame 88. Target grid 86 is preferably made of a generally rigid, transparent polymer substrate, and target frame 88 is preferably made of a generally rigid, light weight material. For example, one suitable material for target frame 88 is an acoustic composite material (see, e.g., U.S. Pat. No. 5,658,656 (Whitney et al.) the disclosure of which is incorporated herein by reference) having generally light weight, rigid properties.

Figure 7:
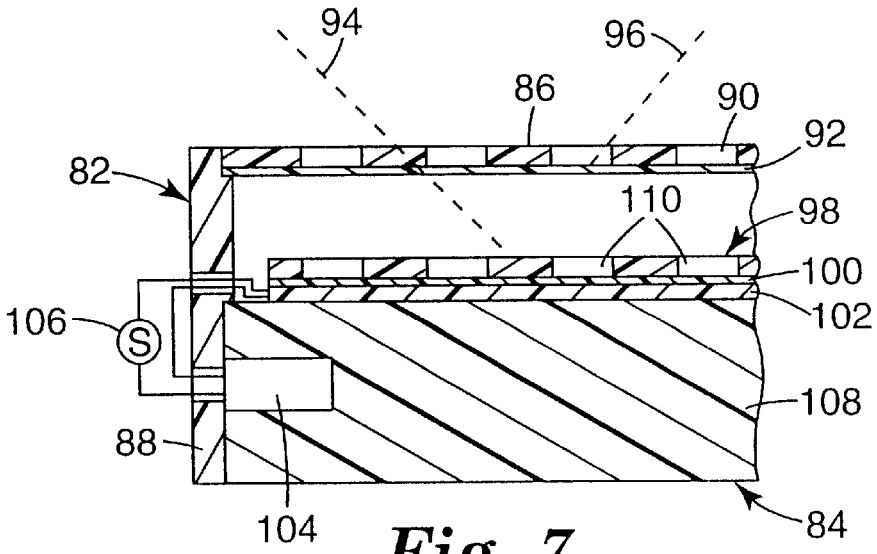
FIG. 7 is a partial perspective view taken along lines 7—7 of FIG. 6.

In FIG. 7, a partial cross-sectional view taken along line 7—7 of FIG. 6 is shown. Target unit 82, which includes directional viewing screen 92 positioned beneath target grid 86, is shown positioned over ocean unit 84. Directional viewing screen 92 can be similar to first directional viewing screen 34 and/or second directional viewing screen 38 as previously described herein. Directional viewing screen 92 is optionally secured to target grid 86 or target frame 88. As indicated by optical paths 94, 96, directional viewing screen 92 operates in a transmissive mode when viewed from a first direction, indicated by optical path 94. Directional viewing screen 92 operates in a non-transmissive mode when viewed from a second, adjacent or opposite direction, indicated by optical path 96.

Ocean unit 84 is removably positioned beneath target unit 82. In the exemplary embodiment shown, ocean unit 84 includes ocean grid 98, color film 100, light source 102, power source 104, switch 106, and frame 108.

Ocean grid 98 can be similar to target grid 86 and includes ocean grid holes 110 passing therethrough. Ocean grid holes 110 are in vertical alignment with target grid holes 90. As shown, target grid holes 90 are located directly above ocean grid holes 110. Similar to target grid 86, ocean grid 98 is formed of a generally rigid material. Ocean grid 98 may be translucent or opaque. In one exemplary embodiment, ocean grid 98 is made of a transparent, rigid polymer, although suitable materials may be apparent to those skilled in the art after reviewing the disclosure of the present invention.

Color film 100, which preferably has a generally blue or bluish green color, is positioned beneath ocean grid 98. Since ocean grid 98 is transparent, color film 100 can enhance ocean grid 98 by giving it the appearance of a blue ocean.

Color film 100 can be, for example, a color shifting film which is partially transmissive. Certain preferred color shifting films comprise alternating layers of at least a first and second polymeric material, wherein at least one of the first or second polymeric materials is birefringent, wherein the difference in indices of refraction of the first and second polymeric materials for visible light polarized along first and second axes in the plane of the layers is at least about 0.05, and wherein the difference in indices of refraction of the first and second polymeric materials for visible light polarized along a third axis mutually orthogonal to the first and second axes is less than about 0.05. Preferably, such color shifting film has at least one transmission band in the visible region of the spectrum and at least one reflection band (preferably having a peak reflectivity of at least about 70%, more preferably, at least 85%, even more preferably, at least 95%) in the visible region of the spectrum.

In another aspect, preferably at least one of the first or second polymeric materials of the color shifting film is positively or negatively birefringent. In another aspect, preferably such difference in indices of refraction of the first and second polymeric materials for visible light polarized along first and second axes in the plane of the layers is $\Delta x$ and $\Delta y$, respectively, wherein the difference in indices of refraction of s the first and second polymeric materials for visible light polarized along a third axis mutually orthogonal to the first and second axes is $\Delta z$, and wherein the absolute value of $\Delta z$ is less than about one half (in some embodiments one quarter) the larger of the absolute value of $\Delta x$ and the absolute value of $\Delta y$.

Further with regard to preferred color shifting film, at least one of the first and second materials can be a strain hardening polyester (e.g., a naphthalene dicarboxylic acid polyester or a methacrylic acid polyester). In other aspect, the first polymeric material can be polyethylene naphthalate and the second polymeric material polymethylmethacrylate.

Color shifting films used in some embodiments of the present invention include those disclosed in U.S. Ser. No. 09/006,591, filed Jan. 13, 1998, and having, the disclosure of which is incorporated herein by reference. These color shifting films are multilayer birefringent polymeric films having particular relationships between the refractive indices of successive layers for light polarized along mutually orthogonal in-plane axes (the x-axis and the y-axis) and along an axis perpendicular to the in-plane axes (the z-axis). In particular, the differences in refractive indices along the x-, y-, and z-axes ($\Delta x$, $\Delta y$, and $\Delta z$, respectively) are such that the absolute value of $\Delta z$ is less than about one half (in some embodiments one quarter, or even one tenth) larger of the absolute value of $\Delta x$ and the absolute value of $\Delta y$ (e.g., ($|\Delta z|<0.5$ k (in some embodiments 0.25 k, or even 0.1 k), $k=\max\{|\Delta x|, |\Delta y|\}$). Films having this property can be made to exhibit transmission spectra in which the widths and intensities of the transmission or reflection peaks (when plotted as a function of frequency, or $1/\lambda$) for p-polarized light remain essentially constant over a wide range of viewing angles, but shift in wavelength as a function of angle. Also for p-polarized light, the spectral features shift toward the blue region of the spectrum at a higher rate with angle change than the spectral features of isotropic thin film stacks. In some embodiments, these color shifting films have at least one optical stack in which the optical thicknesses of the individual layers change monotonically in one direction (e.g., increasing or decreasing) over a first portion of the stack, and then change monotonically in a different direction or remain constant over at least a second portion of the stack. Color shifting films having stack designs of this type exhibit a sharp band edge at one or both sides of the reflection bands(s), causing the film to exhibit sharp, eye-catching color changes as a function of viewing angle.

Further, color shifting films can be regarded as special cases of mirror and polarizing (optical) films. Various process considerations are important in making high quality optical films and other optical devices in accordance with the present invention. Such optical films include, but are not limited to, polarizers, mirrors, colored films, and combinations thereof, which are optically effective over diverse portions of the ultraviolet, visible, and infrared spectra. The process conditions used to make each film will depend in part on the particular resin system used and the desired optical properties of the final film. The following description is intended as an overview of those process considerations common to many resin systems used in making the coextruded optical films useful for the present invention.

Material Selection

Regarding the materials from which the films are to be made, there are several conditions which must be met that are common to certain preferred multilayer optical films for use in the present invention. First, these films comprise at least two distinguishable polymers. The number is not limited, and three or more polymers may be advantageously used in particular films. Second, one of the two required polymers, referred to as the "first polymer", must have a stress optical coefficient having a large absolute value. In other words, it must be capable of developing a large birefringence when stretched. Depending on the application, this birefringence may be developed between two orthogonal directions in the plane of the film, between one or more in-plane directions and the direction perpendicular to the film plane, or a combination of these. Third, the first polymer must be capable of maintaining this birefringence after stretching, so that the desired optical properties are imparted to the finished film. Fourth, the other required polymer, referred to as the "second polymer", must be chosen so that in the finished film, its refractive index, in at least one direction, differs significantly from the index of refraction of the first polymer in the same direction. Because polymeric materials are dispersive, that is, the refractive indices vary with wavelength, these conditions must be considered in terms of a spectral bandwidth of interest.

Other aspects of polymer selection depend on specific applications. For polarizing films, it is advantageous for the difference in the index of refraction of the first and second polymers in one film-plane direction to differ significantly in the finished film, while the difference in the orthogonal film-plane index is minimized. If the first polymer has a large refractive index when isotropic, and is positively birefringent (that is, its refractive index increases in the direction of stretching), the second polymer will be chosen to have a matching refractive index, after processing, in the planar direction orthogonal to the stretching direction, and a refractive index in the direction of stretching which is as low as possible. Conversely, if the first polymer has a small refractive index when isotropic, and is negatively birefringent, the second polymer will be chosen to have a matching refractive index, after processing, in the planar direction orthogonal to the stretching direction, and a refractive index in the direction of stretching which is as high as possible.

Alternatively, it is possible to select a first polymer which is positively birefringent and has an intermediate or low refractive index when isotropic, or one which is negatively birefringent and has an intermediate or high refractive index when isotropic. In these cases, the second polymer may be chosen so that, after processing, its refractive index will match that of the first polymer in either the stretching direction or the planar direction orthogonal to stretching. Further, the second polymer will be chosen such that the difference in index of refraction in the remaining planar direction is maximized, regardless of whether this is best accomplished by a very low or very high index of refraction in that direction.

One means of achieving this combination of planar index matching in one direction and mismatching in the orthogonal direction is to select a first polymer which develops significant birefringence when stretched, and a second polymer which develops little or no birefringence when stretched, and to stretch the resulting film in only one planar direction. Alternatively, the second polymer may be selected from among those which develop birefringence in the sense opposite to that of the first polymer (negative-positive or positive-negative). Another alternative method is to select both first and second polymers which are capable of developing birefringence when stretched, but to stretch in two orthogonal planar directions, selecting process conditions, such as temperatures, stretch rates, post-stretch relaxation, and the like, which result in development of unequal levels of orientation in the two stretching directions for the first polymer, and levels of orientation for the second polymer such that one in-plane index is approximately matched to that of the first polymer, and the orthogonal in-plane index is significantly mismatched to that of the first polymer. For example, conditions may be chosen such that the first polymer has a biaxially oriented character in the finished film, while the second polymer has a predominantly uniaxially oriented character in the finished film.

The foregoing is meant to be exemplary, and it will be understood that combinations of these and other techniques may be employed to achieve the polarizing film goal of index mismatch in one in-plane direction and relative index matching in the orthogonal planar direction.

Different considerations apply to a reflective, or mirror, film. Provided that the film is not meant to have some polarizing properties as well, refractive index criteria apply equally to any direction in the film plane, so it is typical for the indices for any given layer in orthogonal in-plane directions to be equal or nearly so. It is advantageous, however, for the film-plane indices of the first polymer to differ as greatly as possible from the film-plane indices of the second polymer. For this reason, if the first polymer has a high index of refraction when isotropic, it is advantageous that it also be positively birefringent. Likewise, if the first polymer has a low index of refraction when isotropic, it is advantageous that it also be negatively birefringent. The second polymer advantageously S develops little or no birefringence when stretched, or develops birefringence of the opposite sense (positive-negative or negative-positive), such that its film-plane refractive indices differ as much as possible from those of the first polymer in the finished film. These criteria may be combined appropriately with those listed above for polarizing films if a mirror film is meant to have some degree of polarizing properties as well.

As mentioned above, color shifting films can be regarded as special cases of mirror and polarizing films. Thus, the same criteria outlined above apply. The perceived color is a result of reflection or polarization over one or more specific bandwidths of the spectrum. The bandwidths over which a multilayer film of the current invention is effective will be determined primarily by the distribution of layer thicknesses employed in the optical stack(s), but consideration must also be given to the wavelength dependence, or dispersion, of the refractive indices of the first and second polymers. It will be understood that the same rules apply to the infrared and ultraviolet wavelengths as to the visible colors.

Absorbance is another consideration. For most applications, it is advantageous for neither the first polymer nor the second polymer to have any absorbance bands within the bandwidth of interest for the film in question. Thus, all incident light within the bandwidth is either reflected or transmitted. However, for some applications, it may be useful for one or both of the first and second polymer to absorb specific wavelengths, either totally or in part.

Polyethylene 2,6-naphthalate (PEN) is frequently chosen as a first polymer for films useful for the present invention. It has a large positive stress optical coefficient, retains birefringence effectively after stretching, and has little or no absorbance within the visible range. It also has a large index of refraction in the isotropic state. Its refractive index for polarized incident light of 550 nm wavelength increases when the plane of polarization is parallel to the stretch direction from about 1.64 to as high as about 1.9. Its birefringence can be increased by increasing its molecular orientation which, in turn, may be increased by stretching to greater stretch ratios with other stretching conditions held fixed.

Other semicrystalline naphthalene dicarboxylic polyesters are also suitable as first polymers. Polybutylene 2,6-Naphthalate (PBN) is an example. These polymers may be homopolymers or copolymers, provided that the use of comonomers does not substantially impair the stress optical coefficient or retention of birefringence after stretching. The term "PEN" herein will be understood to include copolymers of PEN meeting these restrictions. In practice, these restrictions imposes an upper limit on the comonomer content, the exact value of which will vary with the choice of comonomer(s) employed. Some compromise in these properties may be accepted, however, if comonomer incorporation results in improvement of other properties. Such properties include but are not limited to improved interlayer adhesion, lower melting point (resulting in lower extrusion temperature), better rheological matching to other polymers in the film, and advantageous shifts in the process window for stretching due to change in the glass transition temperature.

Suitable comonomers for use in PEN, PBN or the like may be of the diol or dicarboxylic acid or ester type. Dicarboxylic acid comonomers include but are not limited to terephthalic acid, isophthalic acid, phthalic acid, all isomeric naphthalenedicarboxylic acids (2,6-, 1,2-, 1,3-, 1,4-, 1,5-, 1,6-, 1,7-, 1,8-, 2,3-, 2,4-, 2,5-, 2,7-, and 2,8-), bibenzoic acids such as 4,4'-biphenyl dicarboxylic acid and its isomers, trans-4,4'-stilbene dicarboxylic acid and its isomers, 4,4'-diphenyl ether dicarboxylic acid and its isomers, 4,4'-diphenylsulfone dicarboxylic acid and its isomers, 4,4'-benzophenone dicarboxylic acid and its isomers, halogenated aromatic dicarboxylic acids such as 2-chloroterephthalic acid and 2,5-dichloroterephthalic acid, other substituted aromatic dicarboxylic acids such as tertiary butyl isophthalic acid and sodium sulfonated isophthalic acid, cycloalkane dicarboxylic acids such as 1,4-cyclohexanedicarboxylic acid and its isomers and 2,6-decahydronaphthalene dicarboxylic acid and its isomers, bi- or multi-cyclic dicarboxylic acids (such as the various isomeric norbornane and norbornene dicarboxylic acids, adamantane dicarboxylic acids, and bicyclo-octane dicarboxylic acids), alkane dicarboxylic acids (such as sebacic acid, adipic acid, oxalic acid, malonic acid, succinic acid, glutaric acid, azelaic acid, and dodecane dicarboxylic acid.), and any of the isomeric dicarboxylic acids of the fused-ring aromatic hydrocarbons (such as indene, anthracene, pheneanthrene, benzonaphthene, fluorene and the like). Alternatively, alkyl esters of these monomers, such as dimethyl terephthalate, may be used.

Suitable diol comonomers include but are not limited to linear or branched alkane diols or glycols (such as ethylene glycol, propanediols such as trimethylene glycol, butanediols such as tetramethylene glycol, pentanediols such as neopentyl glycol, hexanediols, 2,2,4-trimethyl-1,3-pentanediol and higher diols), ether glycols (such as diethylene glycol, triethylene glycol, and polyethylene glycol), chain-ester diols such as 3-hydroxy-2,2-dimethylpropyl-3-hydroxy-2,2-dimethyl propanoate, cycloalkane glycols such as 1,4-cyclohexanedimethanol and its isomers and 1,4-cyclohexanediol and its isomers, bi- or multicyclic diols (such as the various isomeric tricyclodecane dimethanols, norbornane dimethanols, norbornene dimethanols, and bicyclo-octane dimethanols), aromatic glycols (such as 1,4-benzenedimethanol and its isomers, 1,4-benzenediol and its isomers, bisphenols such as bisphenol A, 2,2'-dihydroxy biphenyl and its isomers, 4,4'-dihydroxymethyl biphenyl and its isomers, and 1,3-bis(2-hydroxyethoxy)benzene and its isomers), and lower alkyl ethers or diethers of these diols, such as dimethyl or diethyl diols.

Tri- or polyfunctional comonomers, which can serve to impart a branched structure to the polyester molecules, can also be used. They may be of either the carboxylic acid, ester, hydroxy or ether types. Examples include, but are not limited to, trimellitic acid and its esters, trimethylol propane, and pentaerythritol.

Also suitable as comonomers are monomers of mixed functionality, including hydroxycarboxylic acids such as parahydroxybenzoic acid and 6-hydroxy-2-naphthalenecarboxylic acid, and their isomers, and tri- or polyfunctional comonomers of mixed functionality such as 5-hydroxyisophthalic acid and the like.

Polyethylene terephthalate (PET) is another material that exhibits a significant positive stress optical coefficient, retains birefringence effectively after stretching, and has little or no absorbance within the visible range. Thus, it and its high PET-content copolymers employing comonomers listed above may also be used as first polymers in some applications of the current invention.

When a naphthalene dicarboxylic polyester such as PEN or PBN is chosen as first polymer, there are several approaches which may be taken to the selection of a second polymer. One preferred approach for some applications is to select a naphthalene dicarboxylic copolyester (coPEN) formulated so as to develop significantly less or no birefringence when stretched. This can be accomplished by choosing comonomers and their concentrations in the copolymer such that crystallizability of the coPEN is eliminated or greatly reduced. One typical formulation employs as the dicarboxylic acid or ester components dimethyl naphthalate at from about 20 mole percent to about 80 mole percent and dimethyl terephthalate or dimethyl isophthalate at from about 20 mole percent to about 80 mole percent, and employs ethylene glycol as diol component. Of course, the corresponding dicarboxylic acids may be used instead of the esters. The number of comonomers which can be employed in the formulation of a coPEN second polymer is not limited. Suitable comonomers for a coPEN second polymer include but are not limited to all of the comonomers listed above as suitable PEN comonomers, including the acid, ester, hydroxy, ether, tri- or polyfunctional, and mixed functionality types.

Often it is useful to predict the isotropic refractive index of a coPEN second polymer. A volume average of the refractive indices of the monomers to be employed has been found to be a suitable guide. Similar techniques well-known in the art can be used to estimate glass transition temperatures for coPEN second polymers from the glass transitions of the homopolymers of the monomers to be employed.

In addition, polycarbonates having a glass transition temperature compatible with that of PEN and having a refractive index similar to the isotropic refractive index of PEN are also useful as second polymers. Polyesters, copolyesters, polycarbonates, and copolycarbonates may also be fed together to an extruder and transesterified into new suitable copolymeric second polymers.

It is not required that the second polymer be a copolyester or copolycarbonate. Vinyl polymers and copolymers made from monomers such as vinyl naphthalenes, styrenes, ethylene, maleic anhydride, acrylates, acetates, and methacrylates may be employed. Condensation polymers other than polyesters and polycarbonates may also be used. Examples include: polysulfones, polyamides, polyurethanes, polyamic acids, and polyimides. Naphthalene groups and halogens such as chlorine, bromine and iodine are useful for increasing the refractive index of the second polymer to a desired level. Acrylate groups and fluorine are particularly useful in decreasing refractive index when this is desired.

It will be understood from the foregoing discussion that the choice of a second polymer is dependent not only on the intended application of the multilayer optical film in question, but also on the choice made for the first polymer, and the processing conditions employed in stretching. Suitable second polymer materials include but are not limited to polyethylene naphthalate (PEN) and isomers thereof (such as 2,6-, 1,4-, 1,5-, 2,7-, and 2,3-PEN), polyalkylene terephthalates (such as polyethylene terephthalate, polybutylene terephthalate, and poly-1,4-cyclohexanedimethylene terephthalate), other polyesters, polycarbonates, polyarylates, polyamides (such as nylon 6, nylon 11, nylon 12, nylon 4/6, nylon 6/6, nylon 6/9, nylon 6/10, nylon 6/12, and nylon 6/T), polyimides (including thermoplastic polyimides and polyacrylic imides), polyamide-imides, polyetheramides, polyetherimides, polyaryl ethers (such as polyphenylene ether and the ring-substituted polyphenylene oxides), polyarylether ketones such as polyetheretherketone ("PEEK"), aliphatic polyketones (such as copolymers and terpolymers of ethylene and/or propylene with carbon dioxide), polyphenylene sulfide, polysulfones (including polyethersulfones and polyaryl sulfones), atactic polystyrene, syndiotactic polystyrene ("sPS") and its derivatives (such as syndiotactic poly-alpha-methyl styrene and syndiotactic polydichlorostyrene), blends of any of these polystyrenes (with each other or with other polymers, such as polyphenylene oxides), copolymers of any of these polystyrenes (such as styrene-butadiene copolymers, styrene-acrylonitrile copolymers, and acrylonitrilebutadiene-styrene terpolymers), polyacrylates (such as polymethyl acrylate, polyethyl acrylate, and polybutyl acrylate), polymethacrylates (such as polymethyl methacrylate, polyethyl methacrylate, polypropyl methacrylate, and polyisobutyl methacrylate), cellulose derivatives (such as ethyl cellulose, cellulose acetate, cellulose propionate, cellulose acetate butyrate, and cellulose nitrate), polyalkylene polymers (such as polyethylene, polypropylene, polybutylene, polyisobutylene, and poly(4-methyl)pentene), fluorinated polymers and copolymers (such as polytetrafluoroethylene, polytrifluoroethylene, polyvinylidene fluoride, polyvinyl fluoride, fluorinated ethylene-propylene copolymers, perfluoroalkoxy resins, polychlorotrifluoroethylene, polyethylene-co-trifluoroethylene, polyethylene-co-chlorotrifluoroethylene), chlorinated polymers (such as polyvinylidene chloride and polyvinyl chloride), polyacrylonitrile, polyvinylacetate, polyethers (such as polyoxymethylene and polyethylene oxide), ionomeric resins, elastomers (such as polybutadiene, polyisoprene, and neoprene), silicone resins, epoxy resins, and polyurethanes.

Also suitable are copolymers, such as the copolymers of PEN discussed above as well as any other non-naphthalene group-containing copolyesters which may be formulated from the above lists of suitable polyester comonomers for PEN. In some applications, especially when PET serves as the first polymer, copolyesters based on PET and comonomers from the lists above (coPETs) are especially suitable. In addition, either first or second polymers may consist of miscible or immiscible blends of two or more of the above-described polymers or copolymers (such as blends of sPS and atactic polystyrene, or of PEN and sPS). The coPENs and coPETs described may be synthesized directly, or may be formulated as a blend of pellets where at least one component is a polymer based on naphthalene dicarboxylic acid or terephthalic acid and other components are polycarbonates or other polyesters, such as a PET, a PEN, a coPET, or a coPEN.

Another preferred family of materials for the second polymer for some applications are the syndiotactic vinyl aromatic polymers, such as syndiotactic polystyrene. Syndiotactic vinyl aromatic polymers useful in the current invention include poly(styrene), poly(alkyl styrene)s, poly (aryl styrene)s, poly(styrene halide)s, poly(alkoxy styrene)s, poly(vinyl ester benzoate), poly(vinyl naphthalene), poly (vinylstyrene), and poly(acenaphthalene), as well as the hydrogenated polymers and mixtures or copolymers containing these structural units. Examples of poly(alkyl styrene)s include the isomers of the following: poly(methyl styrene), poly(ethyl styrene), poly(propyl styrene), and poly (butyl styrene). Examples of poly(aryl styrene)s include the isomers of poly(phenyl styrene). As for the poly(styrene halide)s, examples include the isomers of the following: poly(chlorostyrene), poly(bromostyrene), and poly (fluorostyrene). Examples of poly(alkoxy styrene)s include the isomers of the following: poly(methoxy styrene) and poly(ethoxy styrene). Among these examples, particularly preferable styrene group polymers, are: polystyrene, poly (p-methyl styrene), poly(m-methyl styrene), poly(p-tertiary butyl styrene), poly(p-chlorostyrene), poly(m-chloro styrene), poly(p-fluoro styrene), and copolymers of styrene and p-methyl styrene.

Furthermore, comonomers may be used to make syndiotactic vinyl aromatic group copolymers. In addition to the monomers for the homopolymers listed above in defining the syndiotactic vinyl aromatic polymers group, suitable comonomers include olefin monomers (such as ethylene, propylene, butenes, pentenes, hexenes, octenes or decenes), diene monomers (such as butadiene and isoprene), and polar vinyl monomers (such as cyclic diene monomers, methyl methacrylate, maleic acid anhydride, or acrylonitrile).

The syndiotactic vinyl aromatic copolymers of the present invention may be block copolymers, random copolymers, or alternating copolymers.

The syndiotactic vinyl aromatic polymers and copolymers referred to in this invention generally have syndiotacticity of higher than 75% or more, as determined by carbon-13 nuclear magnetic resonance. Preferably, the degree of syndiotacticity is higher than 85% racemic diad, or higher than 30%, or more preferably, higher than 50%, racemic pentad.

In addition, although there are no particular restrictions regarding the molecular weight of these syndiotactic vinyl aromatic polymers and copolymers, preferably, the weight average molecular weight is greater than 10,000 and less than 1,000,000, and more preferably, greater than 50,000 and less than 800,000.

The syndiotactic vinyl aromatic polymers and copolymers may also be used in the form of polymer blends with, for instance, vinyl aromatic group polymers with atactic structures, vinyl aromatic group polymers with isotactic structures, and any other polymers that are miscible with the vinyl aromatic polymers. For example, polyphenylene ethers show good miscibility with many of the previous described vinyl aromatic group polymers.

When a polarizing film is made using a process with predominantly uniaxial stretching, particularly preferred combinations of polymers for optical layers include PEN/coPEN, PET/coPET, PEN/sPS, PET/sPS, PEN/"ESTAR," and PET/"ESTAR," where "coPEN" refers to a copolymer or blend based upon naphthalene dicarboxylic acid (as described above) and "ESTAR" refers to is a polyester or copolyester (believed to comprise cyclohexanedimethylene diol units and terephthalate units) commercially available under the trade designation "ESTAR" from Eastman Chemical Co. When a polarizing film is to be made by manipulating the process conditions of a biaxial stretching process, particularly preferred combinations of polymers for optical layers include PEN/coPEN, PEN/PET, PEN/PBT, PEN/PETG and PEN/PETcoPBT, where "PBT" refers to polybutylene terephthalate, "PETG" refers to a copolymer of PET employing a second glycol (usually cyclohexanedimethanol), and "PETcoPBT" refers to a copolyester of terephthalic acid or an ester thereof with a mixture of ethylene glycol and 1,4-butanediol.

Particularly preferred combinations of polymers for optical layers in the case of mirrors or colored films include PEN/PMMA, PET/PMMA, PEN/"ECDEL," PET/"ECDEL," PEN/sPS, PET/sPS, PEN/coPET, PEN/PETG, and PEN/ "THV," where "PMMA" refers to polymethyl methacrylate, "ECDEL" refers to a thermoplastic polyester or copolyester (believed to comprise cyclohexanedicarboxylate units, polytetramethylene ether glycol units, and cyclohexanedimethanol units) commercially available under the trade designation "ECDEL" from Eastman Chemical Co., "coPET" refers to a copolymer or blend based upon terephthalic acid (as described above), "PETG" refers to a copolymer of PET employing a second glycol (usually cyclohexanedimethanol), and "THV" is a fluoropolymer commercially available under the trade designation "THV" from the 3M Company.

It is sometimes preferred for the multilayer optical films of the current invention to consist of more than two distinguishable polymers. A third or subsequent polymer might be fruitfully employed as an adhesion-promoting layer between the first polymer and the second polymer within an optical stack, as an additional component in a stack for optical purposes, as a protective boundary layer between optical stacks, as a skin layer, as a functional coating, or for any other purpose. As such, the composition of a third or subsequent polymer, if any, is not limited. Preferred multicomponent constructions are described in copending application having U.S. Ser. No. 09/006,118, filed Jan. 13, 1998, the disclosure of which is incorporated by reference.

Detailed process considerations and additional layers are included in copending application having U.S. Ser. No. 09/006,288, filed Jan. 13, 1998, the disclosure of which is incorporated by reference. Further, additional details regarding optical films are described in applications having U.S. Ser. Nos. 08/402,041, filed Mar. 10, 1995; 08/494,366, filed Jun. 26, 1995; and 09/006,601 filed Jan. 13, 1998, the disclosures of which are incorporated herein by reference.

Certain preferred color shifting films used in the present invention are advantageous over prior art color films in many respects. For example, while color shifting films based on isotropic materials are known, these preferred films exhibit decreased reflectivities at non-normal angles of incidence, which diminishes the intensity of the reflected wavelengths at non-normal angles of incidence. Hence, such films appear lighter and have less saturated colors at oblique angles. Other color shifting films change their spectral profile as a function of angle, resulting in diminished color purity and/or less dramatic color shifts with angle.

Optional light source 102 is positioned beneath color film 100 and ocean grid 98. Light source 102 is optionally a uniform light source which enhances the color effect of ocean grid 98. Further, since directional viewing screen 92 may have a polarizing or darkening effect, light source 102 may also enhance the viewability of the ships positioned on ocean grid 98, when viewed along optical path 94.

In one aspect, light source 102 preferably includes an electroluminescent sheet device. Suitable electroluminescent sheet devices (also referred to as "electroluminescent (sheet) lamps") are known in the art, and rely on the electroluminescence of a light emitting material (e.g., phosphor material, organic light emitter (e.g., a triphenyldiamine derivative (TPD), poly phenylene vinylene (PPV), quinolinol metal complex (Al-q), or the like (e.g., Mn-doped ZnS, or alkaline earth thiogallates (e.g., $CaGa_2S_4$)))) in the presence of an electric field, wherein the phosphor (or the like) becomes excited and emits photons. Most of the radiated energy falls within the visible range of the spectrum. Generally, an electroluminescent sheet device is electrically similar to a capacitor and comprises a dielectric layer comprising light-emitting phosphor (or the like) sandwiched between two electrically conductive layers. At least one additional dielectric layer may also be present. The primary purpose of the additional dielectric layer is to allow the electroluminescent material (i.e., the phosphors material or the like) to withstand higher voltages without shorting between the conductive surfaces. Electroluminescent devices illuminate when powered with an applied voltage. Suitable electroluminescent devices as known in the art are energized using an alternating current (AC) voltage. As voltage is applied to the conductive surfaces, an electric field is generated across the phosphor (or other material) and dielectric layers. Electrons are excited from the valance band into the conduction band or injected into the conduction band of the luminescent material Many of these excited electrons decay to lower energy states with the emission of light. Emitted light passes through a transparent front electrode (of the device) as they return to their ground states. Preferably, electroluminescent sheet devices utilized in the practice of the present invention are flat or planer. Typically, electroluminescent sheet devices have a thickness in the range from about 0.05 mm to about 20 mm, more typically, about 0.1 to about 5 mm, depending, for example, on the type of device and substrate.

Generally, there are at least three types of electroluminescent sheet devices, which are sometimes referred to as "organic thin film-type" (small molecule-types (see, e.g., U.S. Pat. Nos. 4,356,429 (Tang), 5,409,783 (Tang) 5,554,450 (Shi et al.)) and "conjugated polymer-type" (see, e.g., U.S. Pat. No. 5,247,190 (Friend et al.)); "inorganic thin film-type" (see, e.g., U.S. Pat. No. 5,598,059 (Sun et al.)); and inorganic particles (or thick film)-type (see, e.g., U.S. Pat. Nos. 5,469,019 (Mori), 5,508,585 (Butt), 5,156,885 (Budd), 5,418,062 (Budd), 5,439,705 (Budd), 5,491,377 (Janusaukas), and 5,593,782 (Budd)). The disclosures of U.S. Pat. Nos. 5,156,885 (Budd), 5,418,062 (Budd), and 5,439,705 (Budd) are incorporated herein by reference.

Electroluminescent devices can be tailored through the use, for example, of different compositions and/or filters to provide a variety of colors (e.g., violet, blue, blue-green, orange, white, orange-yellow, yellow, and red). Unlike filament or fluorescent lamps, electroluminescent devices do not fail catastrophically or abruptly fail, but rather the brightness of the lamp gradually decreases over long periods of time. The characteristics of the degradation behavior can vary with the different types of electroluminescent devices and materials. Electroluminescent lamp life is typically affected by voltage, frequency, temperature, oxygen, and humidity. Humidity is typically highly detrimental to the luminescent materials in all types of lamps, unless such effect is controlled. Techniques for protecting the lamp material from the effects of humidity are known in the art, and particularly prevalent for the commercially available lamps. Thin film types are generally fabricated on glass substrates, and are protected on the non-light emitting side by metal or other inorganic coatings. Organic types are generally sealed with a second sheet of glass. Thick film particulate type lamps are particularly advantageous because there are currently robust lamps which do not require a glass substrate. Moisture protection is achieved by macroencapsulating the entire lamp structure with sheets of a low permeability polymer (such as that available under the trade designation "ACLAR" from Allied Chemical), or by microencapsulating the particulate phosphor material in a moisture resistant or proof material, such as oxide materials (e.g., titania, alumina, and silica) (see, e.g., U.S. Pat. Nos. 5,156,885 (Budd), 5,418,062 (Budd), 5,439,705 (Budd), and 5,593,782 (Budd), the disclosures of which were incorporated herein by reference above).

Particulate electroluminescent phosphors, for example, are most commonly used in thick film constructions. These devices typically include a layer of an organic dielectric matrix (e.g. polyester, polyethylene terephthalate, cellulosic materials, etc.), preferably having a high dielectric constant, loaded with phosphor particles (e.g., sulfide-based phosphor particles). Such layers are typically coated on a plastic substrate having a transparent front electrode. A rear electrode (e.g., an aluminum foil or screen printed silver ink) is typically applied to the back side of the phosphor layer. When an electric field is applied across the electrodes, the proximate portions of the layer emit light as the phosphor particles therein are excited. Such constructions may further comprise optional dielectric layers between the phosphor layer and rear electrodes.

One preferred electroluminescent (thick film) device comprises, in order, a first electrode, a layer of dielectric matrix loaded with encapsulated electroluminescent phosphor particles, and a rear electrode, wherein the encapsulated phosphor particles each comprise a particle of zinc sulfide-based electroluminescent phosphor which is essentially completely encapsulated within a substantially transparent, continuous metal oxide precursors, and wherein the encapsulated phosphor particles have an initial electroluminescent brightness which is equal to or greater than about 50 percent of the initial electroluminescent brightness of the uncoated phosphor particle, and the percent of electroluminescent brightness retained by the encapsulated phosphor particles following 100 hours operation in an environment having a relative humidity of at least 95 percent is greater that about 70 percent of the intrinsic brightness retained following 100 hours operation, the initial brightness and change in electroluminescent brightness in an environment having a relative humidity of at least 95 percent and intrinsic brightness change being measured under substantially the same operating conditions (for further details, see U.S. Pat. No. 5,593,782 (Budd), the disclosure of which was incorporated herein by reference above).

Preferably, the electroluminescent material (e.g., phosphor) is encapsulated to reduce, minimize, or prevent the effects of moisture or humidity on the life of the device (see, e.g., U.S. Pat. Nos. 5,156,885 (Budd), 5,418,062 (Budd), 5,439,705 (Budd), and 5,593,782 (Budd), the disclosures of which were incorporated herein by reference above). A commercially available phosphor electroluminescent device, which utilizes encapsulated inorganic particles is available, for example, from Durel Corp. of Chandler, Ariz., under the trade designation "DUREL 3 EL".

Other electroluminescent devices which may be suitable in the practice of the present invention are available, for example, form NEC Corporation of Tokyo, Japan and (under the trade designation "PERMA-LIGHT") from Quantex of Rockville, Md.

Figure 8:
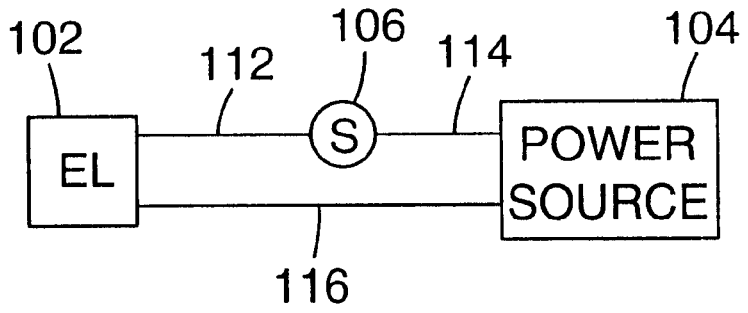
FIG. 8 is an electrical block diagram illustrating one exemplary embodiment of the light source of FIG. 7.

Referring to FIG. 8, light source 102 can be electrically coupled to power source 104 through switch 106 for selective actuation of the light source 102, indicated by electrical coupling 112, 114 and 116. Examples of suitable power sources include a DC power source (e.g., a battery), coupled to an inverter, or an alternating current power source (e.g., in the United States, a household 120 volt wall outlet).

Figure 9:
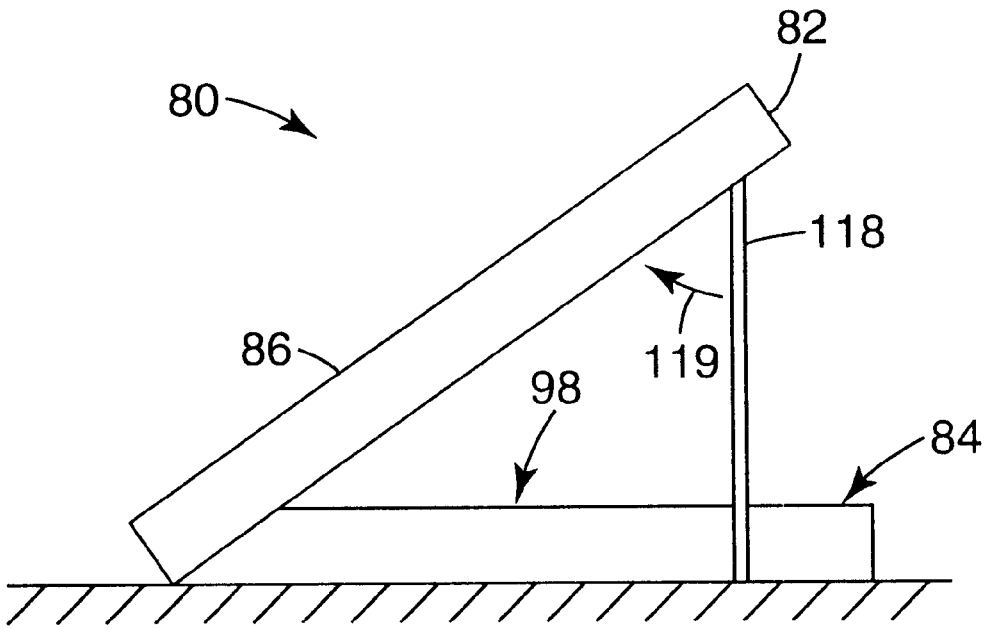
FIG. 9 is a side elevational view illustrating one mode of operation of the game unit of FIG. 6.

Referring to FIG. 9, target unit 82 is removable from ocean unit 84 for accessing the ocean grid 98. In the exemplary embodiment shown, target unit 82 may be lifted upward for accessing ocean unit 84. Further, mechanism 118 is provided for supporting target unit 82 in an open position, allowing a player to access and place their ships on ocean grid 98. Mechanism 118 is storable within target unit 82 (indicated by arrow 119) and is rotatable outward for supporting target unit 82.

Figure 10:
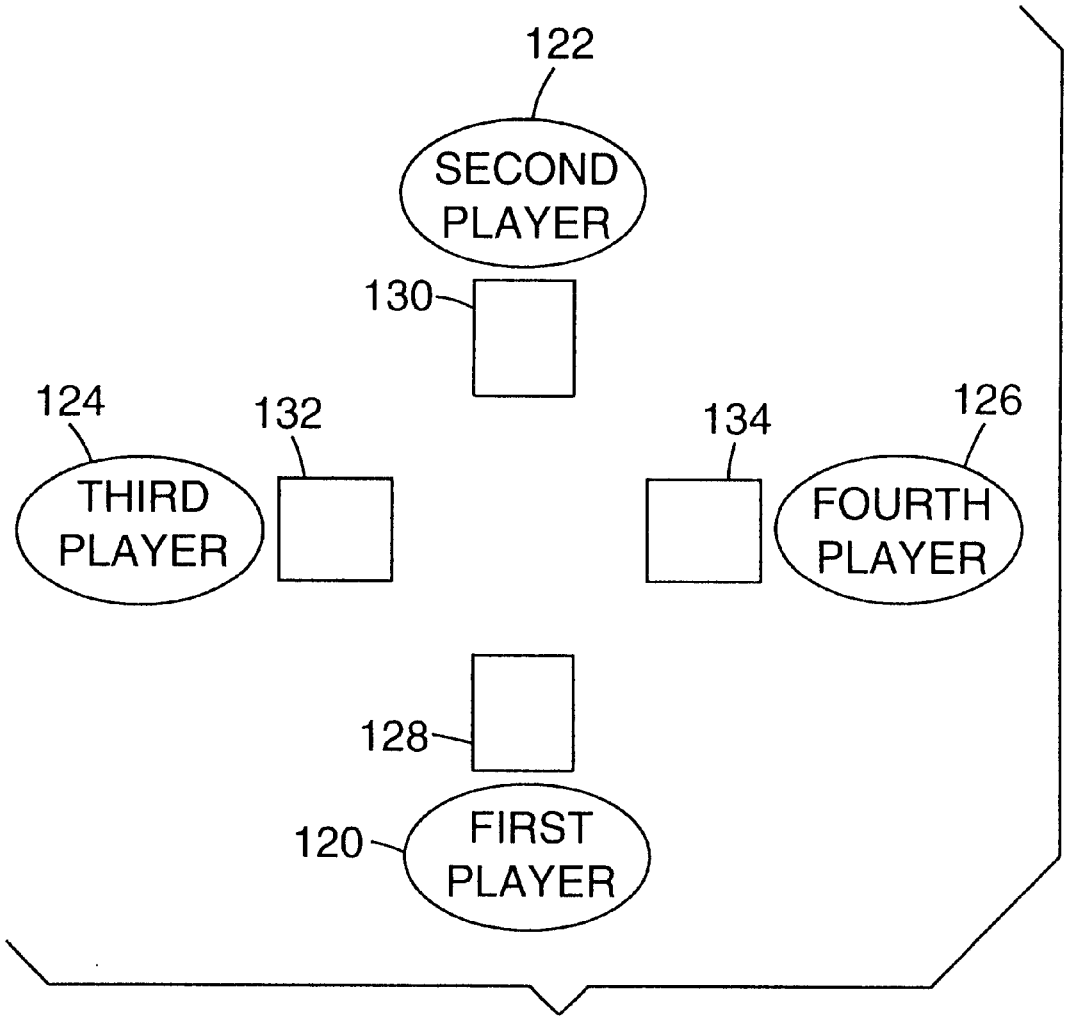
FIG. 10 is a diagram illustrating a changed play pattern such that a game is playable by more than two players.

Certain naval combat games in accordance with the present invention allow more than two players, and as such allow the play pattern to be changed as correspond to the two player versions of naval combat games. Referring to FIG. 10, in the exemplary embodiment shown, first player 120, second player 122, third player 124, and fourth player 126 are positioned to play a naval combat game according to the present invention. Each player 120, 122, 124, 126 has a naval combat game unit, for example, naval combat game unit 80 (see, FIG. 6). That is, as shown, first player 120 has game unit 128, second player 122 has game unit 130, third player 124 game unit 132, and fourth player 126 game unit 134. Each player may view the other players' target grid, but the game units 128, 130, 132, 134 each have a directional viewing screen located therein which allows each player to only see their own respective ocean grid. As such, it is no longer necessary that players be positioned opposite each other, with a vertical play region located therebetween for blocking another player's view of the ocean grid. Further, play is not limited to just two players.

Such naval combat game units enhance game play and changes the play pattern to allow for two or more players. In one exemplary embodiment, each player has a set of battleships that fit into the bottom array of target grid holes in their respective game unit target grid.

One enhanced naval combat game according to the present invention can be played, for example, as follows: Each player places their respective battleships on his or her ocean grid, being careful not to allow the other players to see the placement of the battleships. In reference to FIG. 9, this may be accomplished by opening the game unit towards the respective player, such that placement of the ships may not be seen by an opposing or adjacent player.

In the embodiment shown in FIG. 9, the game units are separate from each other. In other embodiments according to the present invention, the game units may be employed to be separable from a central game play region. Additionally, the game units may be attached to or integral to a central game play region or portions of the game unit may be attached to or integral to a central game play region.

After a player has been selected to start the game, such player attacks the opponent immediately to the left (or across if there are only two players). The attack consists of placing a white peg on the target grid belonging to the player on the left. The attacked player observes the attack, noting whether or not the white peg was placed directly over an underlying battleship located on the ocean grid. If the white peg was placed directly over an underlying battleship, the attack was a hit. Otherwise the attack is a miss. The attacked player announces the result, either a hit or miss. If the attack was a hit, the attacking player replaces the white peg with a red peg in precisely the same target grid hole. If there are three or more players, the other attack is repeated (by the attacking player) on the next player's board, which may be different from the previous attack. Attacks can continue, for example, until all opposing players have been attacked. Alternatively, for example, other attack patterns may be employed.

As play continues, the next player immediately to the left or selected in a clockwise manner (or across if there are only two players, or as otherwise agreed to) attacks all opponents in a similar manner; each attacking player attacks all opposing players' boards by moving from board to board in a clockwise manner. Attacks continue with the attacker being selected by moving from player to player in a clockwise manner.

A player loses when all of his or her battleships have been sunk. A battleship is sunk when all holes immediately above the battleship are filled with red pegs. A player wins when all the ships of other players have been sunk.

Another game within the scope of the present invention is an enhanced version of the game marketed under the trade designation "MASTERMIND". In the conventional version of such game, one player is a code maker and another player is a code breaker. In one version of such game, for example, the code maker secretly puts five code pegs in five holes behind a shield located on the board play region. Any combination of eight colors (e.g., yellow, blue, white, green, brown, orange, red and black) may be used. The code breaker tries to duplicate the exact colors and positions of the secret code. Each time the code breaker places a row of code pegs, the code maker must give information by placing the black and white key pegs in the key peg holes along side the code pegs, or by leaving holes vacant For example, in one method of play, a black key peg is placed in any of the key peg holes for every code peg which is the same color and in exactly the same position as one of the code pegs behind the shield. A white key peg is placed in any of the key peg holes for each hidden code peg which is matched in color but not position by a peg placed by the code breaker (for example, one white key peg is placed if only one red code peg is hidden and the code breaker has placed two or more red code pegs in the wrong position). A vacant key peg hole is left for every code peg placed by the code breaker which is incorrect. When the code breaker duplicates the secret code, the code maker places the five black key pegs and reveals the hidden code. The code maker and the code breaker change positions and play again. The winner is the player with the least number of lines used.

Figure 11:
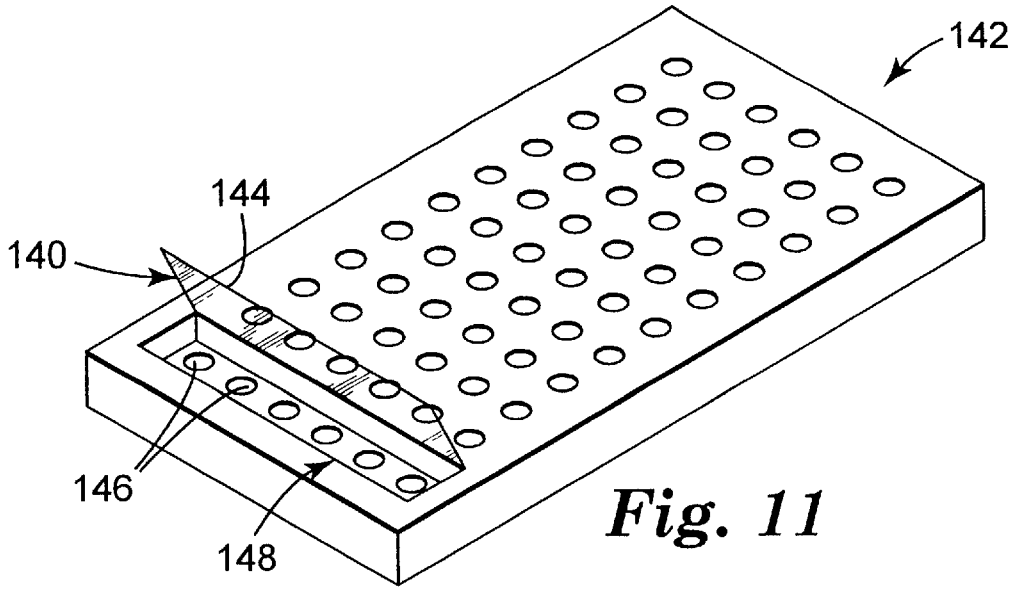
FIG. 11 is a perspective view illustrating another exemplary embodiment showing a code breaker game in accordance with the present invention.
Figure 12:
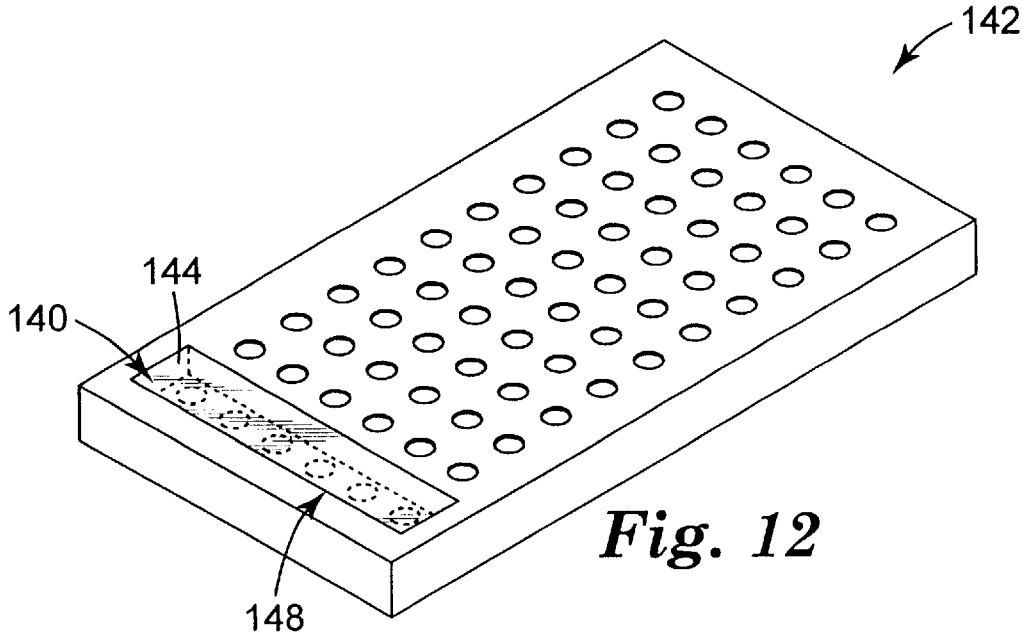
FIG. 12 is another perspective view illustrating an exemplary embodiment of a code breaker game in accordance with the present invention.

In such a code breaker game according to the present invention, for example, the conventional shield for hiding code pegs from the code breaker is replaced with a directional viewing screen as part of a directional viewing member. Referring to FIG. 11, directional viewing member 140 is coupled to enhanced code breaker game board 142. The directional viewing member 140 can be similar to the directional viewing members as previously described herein, and includes directional viewing screen 144. Directional viewing screen 144 can operate similar to the directional viewing screens as previously described herein. Code pegs are positioned within holes 16 located in board recess 148. Referring to FIG. 12, directional viewing screen 144 is closed over board recess 148. As such, the code maker can view the code pegs through the directional viewing screen 144 without having to look underneath a shield, while the directional viewing screen 144 operates to block the code breaker from viewing the code pegs (wherein the code breaker is located in a position different from the code maker).

Components of toys according to the present invention can be made of any of a variety of materials (including those referred to herein). For example, game pieces may be made of non-metallic materials (e.g., cardboard, plastic), or a metallic material. Similarly, game units or game playing surfaces may be made of non-metallic materials (e.g., cardboard, plastic) or metallic materials. Other suitable materials may also be apparent to those skilled in the art after reviewing the disclosure of the present invention.

Many adhesive materials may be used to laminate optical films and devices to another film, surface, or substrate. Such adhesive materials include pressure sensitive adhesives, hot-melt adhesives, solvent-coated adhesives, heat activated adhesives and the like. These adhesive materials preferably are optically clear, diffuse and exhibit non-hazy and non-whitening aging characteristics. Furthermore, the adhesive materials should exhibit long term stablility under high heat and humidity conditions. Suitable adhesive materials may include solvent, heat, or radiation activated adhesive systems. Pressure sensitive adhesive materials are normally tacky at room temperature and can be adhered to a surface by application of light to moderate pressure.

Examples of adhesive materials, whether pressure sensitive or not and useful in the present invention include those based on general compositions of polyacrylate; polyvinyl ether; diene-containing rubbers such as natural rubber, polyisoprene, and polyisobutylene; polychloroprene; butyl rubber; butadiene-acrylonitrile polymers; thermoplastic elastomers; block copolymers such as styrene-isoprene and styrene-isoprene-styrene block copolymers, ethylenepropylene-diene polymers, and styrene-butadiene polymers; polyalphaolefins; amorphous polyolefins; silicone; ethylene-containing copolymers such as ethylene vinyl acetate, ethylacrylate, and ethylmethacrylate; polyurethanes; polyamides; polyesters; epoxies; polyvinylpyrrolidone and vinylpyrrolidone copolymers; and mixtures of the above.

Additionally, adhesive materials can contain additives such as tackifiers, plasticizers, fillers, antioxidants, stabilizers, diffusing particles, curatives, and solvents, provided they do not interfere with the optical characteristics of the devices. When additives are used they are used in quantities that are consistent with there intended use and when used to laminate an optical film to another surface, the adhesive composition and thickness are preferably selected so as not to interfere with the optical properties of the optical film. For example, when laminating additional layers to an optical films or devices wherein a high degree of transmission is desired, the laminating adhesive material should be optically clear in the wavelength region that the optical films or devices is designed to be transparent in.

Further, the surface(s) on which an adhesive material is applied or otherwise attached to may be primed (e.g., chemically, physical (e.g., physical treatment such as roughening), and corona) to affect the degree of attachment between the adhesive material and surface.

The following two examples illustrate exemplary embodiments of the manufacture of color shifting films. Particular materials and amounts thereof recited in these examples, as well as other conditions and details, should not be construed to unduly limit this invention. All parts and percentages are by weight unless otherwise indicated.

EXAMPLE 1

The following example illustrates the preparation of a color shifting film.

A co-extruded film containing 209 layers was made on a sequential flat-film making line via a co-extrusion process. This multilayer polymer film was made from polyethylene naphthalate (PEN) and polymethyl methacrylate (PMMA CP82) where PEN was the outer layers or "skin" layers. A feedblock method (such as that described by U.S. Pat. No. 3,801,429) was used to generate about 209 layers which were co-extruded onto a water chilled casting wheel and continuously oriented by conventional sequential length orienter (LO) and tenter equipment. PEN with an intrinsic viscosity (IV) of 0.56 dl/g (60 wt. % phenol/40 wt. % dichlorobenzene) was delivered to the feedblock by one extruder at a rate of 60.5 kg/hr and the PMMA was delivered by another extruder at a rate of 63.2 Kg/hr. These melt streams were directed to the feedblock to create the PEN and PMMA optical layers. The feedblock created 209 alternating layers of PEN and PMMA with the two outside layers of PEN serving as the protective boundary layers (PBL's) through the feedblock. The PMMA melt process equipment was maintained at about 249° C.; the PEN melt process equipment was maintained at about 290° C.; and the feedblock, skin-layer modules, and die were also maintained at about 290° C.

An approximately linear gradient in layer thickness was designed for the feedblock for each material, with the ratio of thickest to thinnest layers being about 1.72:1. This hardware design of first-to-last layer thickness ratio of 1.73:1 was too great to make the bandwidth desired for the colored mirror of this example. In addition, a sloping blue band edge resulted from the as-designed hardware. To correct these problems, a temperature profile was applied to the feedblock. Selected layers created by the feedblock can be made thicker or thinner by warming or cooling the section of the feedblock where they are created. This technique was required to produce an acceptable sharp band edge on the blue side of the reflection band. The portion of the feedblock making the thinnest layers was heated to 304° C., while the portion making the thickest layers was heated to 274° C. Portions intermediate were heated between these temperature extremes. The overall effect is a much narrower layer thickness distribution which results in a narrower reflectance spectrum.

After the feedblock, a third extruder delivered a 50/50 blend of 0.56 dl/g IV and 0.48 dl/g IV PEN as skin layers (same thickness on both sides of the optical layer stream) at about 37.3 Kg/hr. By this method, the skin layers were of a lower viscosity than the optics layers, resulting in a stable laminar melt flow of the co-extruded layers. Then the material stream passed through a film die and onto a water cooled casting wheel using an inlet water temperature of about 7° C. A high voltage pinning system was used to pin the extrudate to the casting wheel. The pinning wire was about 0.17 mm thick and a voltage of about 5.5 kV was applied. The pinning wire was positioned manually by an operator about 3–5 mm from the web at the point of contact to the casting wheel to obtain a smooth appearance to the cast web.

The cast web was length oriented with a draw ratio of about 3.8:1 at about 130° C. In the tenter, the film was preheated before drawing to about 138° C. in about 9 seconds and then drawn in the transverse direction at about 140° C. to a draw ratio of about 5:1, at a rate of about 60% per second. The finished film had a final thickness of about 0.02 mm.

Figure 13:
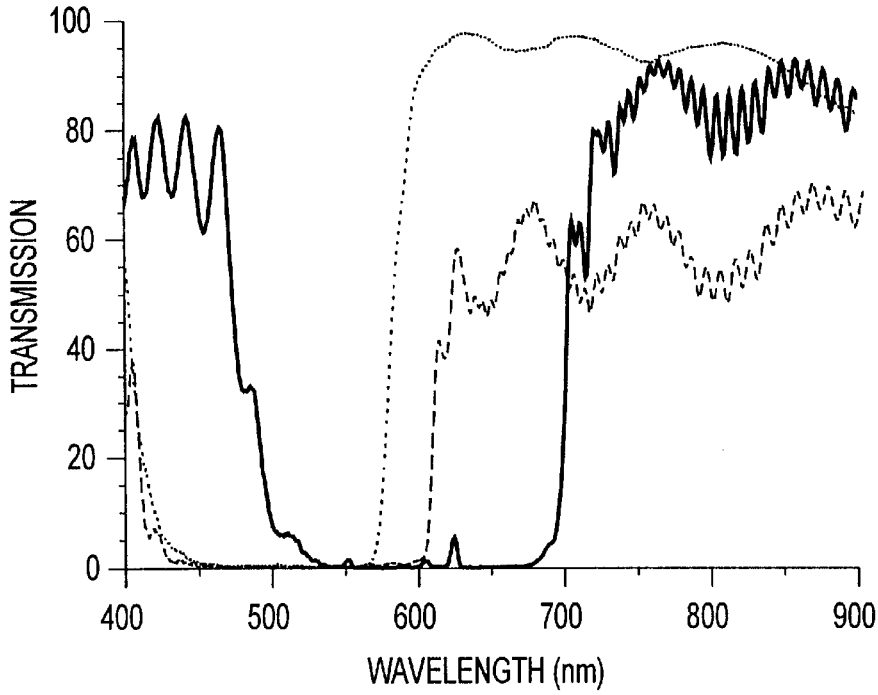
FIGS. 13 and 14 are optical spectra of two color shifting films.

The optical spectra for the film of this example are shown in FIG. 13. The film exhibited blue in transmission at normal incidence; yellow in reflection at normal incidence; red in transmission at oblique angles; and cyan in reflection at oblique angles.

EXAMPLE 2

The following example illustrates the preparation of a another color selective film.

A multilayer film containing about 418 layers was made on a sequential flat-film making line via a co-extrusion process. This multilayer polymer film was made PET and polyester resin (available under the trade designation "ECDEL 9967" from Eastman Chemical Co. of Rochester, N.Y.) where PET was the outer layers or "skin" layers. A feedblock method (such as that described by U.S. Pat. No. 3,801,429) was used to generate about 209 layers with an approximately linear layer thickness gradient from layer to layer through the extrudate.

The PET, with an Intrinsic Viscosity (IV) of 0.56 dl/g was pumped to the feedblock at a rate of about 34.5 Kg/hr and the polyester resin ("ECDEL 9967") at about 41 Kg/hr. After the feedblock, the same PET extruder delivered PET as protective boundary layers (PBL's), to both sides of the extrudate at about 6.8 Kg/hr total flow. The material stream then passed though an asymmetric two times multiplier (U.S. Pat. Nos. 5,094,788 and 5,094,793) with a multiplier ratio of about 1.40. The multiplier ratio is defined as the average layer thickness of layers produced in the major conduit divided by the average layer thickness of layers in the minor conduit. This multiplier ratio was chosen so as to leave a spectral gap between the two reflectance bands created by the two sets of 209 layers. Each set of 209 layers has the approximate layer thickness profile created by the feedblock, with overall thickness scale factors determined by the multiplier and film extrusion rates.

The melt process equipment for the polyester resin ("ECDEL 9967") was maintained at about 250° C., the PET (optics layers) melt process equipment was maintained at about 265° C., and the feedblock, multiplier, skin-layer melt stream, and die were maintained at about 274° C.

The feedblock used to make the film for this example was designed to give a linear layer thickness distribution with a 1.3:1 ratio of thickest to thinnest layers under isothermal conditions. To achieve a smaller ratio for this example, a thermal profile was applied to the feedblock. The portion of the feedblock making the thinnest layers was heated to 285° C., while the portion making the thickest layers was heated to 265° C. In this manner the thinnest layers are made thicker than with isothermal feedblock operation, and the thickest layers are made thinner than under isothermal operation. Portions intermediate were set to follow a linear temperature profile between these two extremes. The overall effect is a narrower layer thickness distribution which results in a narrower reflectance spectrum. Some layer thickness errors are introduced by the multipliers, and account for the minor differences in the spectral features of each reflectance band. The casting wheel speed was adjusted for precise control of final film thickness, and therefore, final color.

After the multiplier, a thick symmetric PBL (skin layers) was added at about 28 Kg/hour that was fed from a third extruder. Then the material stream passed through a film die and onto a water cooled casting wheel. The inlet water temperature on the casting wheel was about 7° C. A high voltage pinning system was used to pin the extrudate to the casting wheel. The pinning wire was about 0.17 mm thick and a voltage of about 5.5 kV was applied. The pinning wire was positioned manually by an operator about 3–5 mm from the web at the point of contact to the casting wheel to obtain a smooth appearance to the cast web. The cast web was continuously oriented by conventional sequential length orienter (LO) and tenter equipment. The web was length oriented to a draw ratio of about 3.3 at about 100° C. The film was preheated to about 100° C. in about 22 seconds in the tenter and drawn in the transverse direction to a draw ratio of about 3.5 at a rate of about 20% per second. The finished film had a final thickness of about 0.05 mm.

Figure 14:
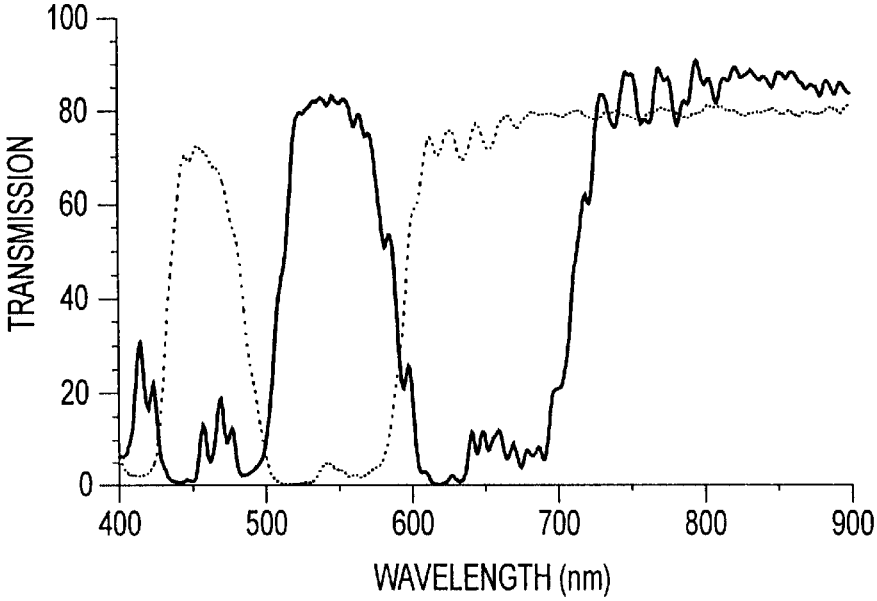

The optical spectra for the film of this example are shown in FIG. 14. The film exhibited green in transmission at normal incidence; magenta in reflection at normal incidence; magenta in transmission at oblique angles; and green in reflection at oblique angles.

It is to be noted that many different colors can be, for example, produced by modifying one or more parameters of the procedures described in Examples 1–2. Thus, for example, within certain limitations, the speed of the casting wheel can be adjusted to result in relative thickening or thinning of the optical layers within the extruded web. This results in a shift of the reflectance band to a different wavelength, which changes the color of the resulting film at a given angle of incidence.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A game comprising:

a play region; and a directional viewing screen;

wherein said directional viewing screen covers at least a portion of said play region, wherein said directional viewing screen has a major surface that is viewable from a first position, and from an opposed, second position, and wherein said directional viewing screen has light control properties that:

(a) allow the covered portion of said play region to be viewed through said major surface of said directional viewing screen from said first position; and (b) obstructs the view of the covered portion of said play region through said major surface of said directional viewing screen from said second position.

2. The game of claim 1, wherein said directional viewing screen comprises a directional film including a viewing orientation.

3. The game of claim 2, wherein said directional film includes multiple layers of film.

4. The game of claim 3, wherein said direction viewing screen comprises a polarizer comprising a louvered plastic film comprising a plurality of clear regions separated by louvers wherein each of said louvers has a central region having a first coefficient of extinction and an outer region adjacent said clear region having a second coefficient of extinction.

5. The game of claim 4, wherein said first coefficient of extinction is at least 1.5 times said second coefficient of extinction.

6. The game of claim 1, further comprising:

a second directional viewing screen adjacent said first directional viewing screen, said second directional viewing screen including a different viewing direction from said first directional viewing screen.

7. The game of claim 1, wherein the covered portion of said game play region is viewable through said directional viewing screen in only one direction.

8. The game of claim 1, said game further comprising:

a second play region; and a second directional viewing screen, wherein said second directional viewing screen covers at least a portion of said second play region, wherein said second directional viewing screen has a major surface that is viewable from first position and from said second position, wherein said second directional viewing screen has light control properties that:

(a) allow the covered portion of said second play region to be viewed through said major surface of said second directional viewing screen from said second position; and (b) obstructs the view of the covered portion of said second play region through said major surface of said second directional viewing screen from said first position.

9. The game of claim 8, wherein said second directional viewing screen comprises a polarizer comprising a louvered plastic film comprising a plurality of clear regions separated by louvers, wherein each of said louvers has a central region having a first coefficient of extinction and an outer region adjacent said clear region having a second coefficient of extinction.

10. The game of claim 9, wherein said first coefficient of extinction is at least 1.5 times said second coefficient of extinction.

11. The game of claim 8, wherein the game is a naval combat game.

12. The game of claim 8, wherein said second play region is attached to said first play region.

13. The game of claim 8, wherein said second play region is separate from said first play region.

14. The game of claim 8, further comprising:

a third play region; and a third directional viewing screen, wherein said third directional viewing screen covers at least a portion of said third play region, wherein said third directional viewing screen has a major surface that is viewable from said first position, said second position, and from a third position that is 90 degrees with respect to each of said first and second positions, wherein said third directional viewing screen has light control properties that:

(a) allow the covered portion of said third play region to be viewed through said major surface of said third directional viewing screen from said third position; and (b) obstructs the view of the covered portion of said third play region through said major surface of said third directional viewing screen from said first and second positions, wherein said major surface of said first directional viewing screen is viewable from said third position, wherein said first directional viewing screen further includes light control properties that obstructs the view of the covered portion of said first play region through said major surface of said first directional viewing screen from said third position, wherein said major surface of said second directional viewing screen is viewable from said third position, wherein said second directional viewing screen further includes light control properties that obstructs the view of the covered portion of said second play region through said major surface of said second directional viewing screen from said third position.

15. The game of claim 14, wherein said third directional viewing screen comprises a polarizer comprising a louvered plastic film comprising a plurality of clear regions separated by louvers, wherein each of said louvers has a central region having a first coefficient of extinction and an outer region adjacent said clear region having a second coefficient of extinction.

16. The game of claim 15, wherein said first coefficient of extinction is at least 1.5 times said second coefficient of extinction.

17. The game of claim 14, wherein the game is a naval combat game.

18. The game of claim 14, further comprising:

a fourth play region; and a fourth directional viewing screen;

wherein said fourth directional viewing screen covers at least a portion of said fourth play region, wherein said fourth directional viewing screen has a major surface that is viewable from said first position, said second position, said third position, and from a fourth position that is 90 degrees with respect to each of said first and third positions, and which is opposed to said second position, wherein said fourth directional viewing screen has light control properties that:

(a) allow the covered portion of said fourth play region to be viewed through said major surface of said fourth directional viewing screen from said fourth position; and b) obstructs the view of the covered portion of said fourth play region through said major surface of said fourth directional viewing screen from said first, second, and third positions, wherein said major surface of said first directional viewing screen is viewable from said fourth position wherein said first directional viewing screen further includes light control properties that obstructs the view of the covered portion of said first play region through said major surface of said first directional viewing screen from said fourth position, wherein said major surface of said second directional viewing screen is viewable from said fourth position, wherein said second directional viewing screen further includes light control properties that obstructs the view of the covered portion of said second play region through said major surface of said second directional viewing screen from said fourth position, wherein said major surface of said third directional viewing screen is viewable from said fourth position, wherein said third directional viewing screen further includes light control properties that obstructs the view of the covered portion of said second play region through said major surface of said third directional viewing screen from said fourth position.

19. The game of claim 18, wherein said fourth directional viewing screen comprises a polarizer comprising a louvered plastic film comprising a plurality of clear regions separated by louvers, wherein each of said louvers has a central region having a first coefficient of extinction and an outer region adjacent said clear region having a second coefficient of extinction.

20. The game of claim 19, wherein said first coefficient of extinction is at least 1.5 times said second coefficient of extinction.

21. The game of claim 18, wherein the game is a naval combat game.

22. The game of claim 18, wherein said directional viewing screen includes multiple layers of directional film.

23. The game of claim 22, wherein each of said layers has a viewing direction, and wherein at least some of said adjacent layers are positioned such that the viewing direction of adjacent layers is different.

24. The game of claim 23, wherein the covered portion of said first play region is viewable through said directional viewing screen in only one direction.

25. The game of claim 1, further comprising:

a power source; and an electroluminescent sheet device coupled to said power source;

wherein said first play region is illuminatable by positioning said first play region adjacent said electroluminescent sheet device.

26. The game of claim 25, further comprising a switch mechanism operably coupled between said power source and said electroluminescent sheet device.

27. The game of claim 1, wherein the game is a code breaker game.

28. The game of claim 1, wherein the game is a crossword game.

* * * * *

UNITED STATES PATENT AND TRADEMARK OFFICE

CERTIFICATE OF CORRECTION

PATENT NO. : 6,120,026
DATED : September 19, 2000
INVENTOR(S) : Whitney et al.

Figure 2:
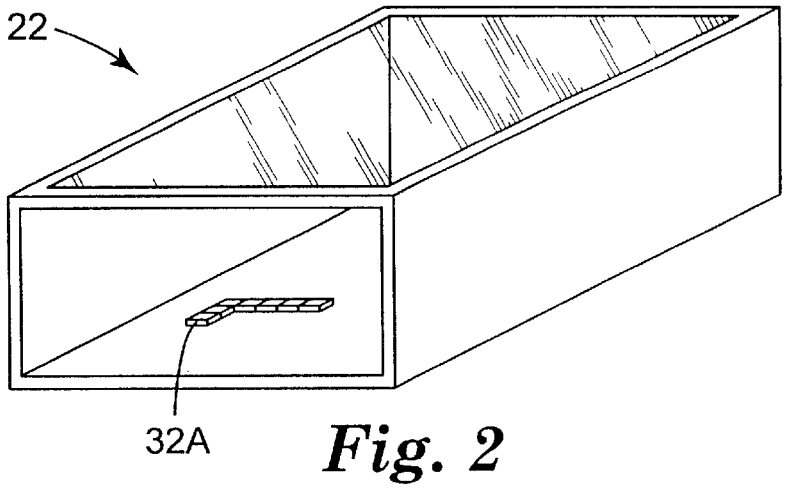
FIG. 2 is a perspective view illustrating an exemplary embodiment of a directional viewing member in accordance with the present invention.

It is certified that error appears in the above-identified patent and that said Letters Patent is hereby corrected as shown below:

Column 4,
Line 49, "FIGS. 1 and 3" should read -- FIGS. 2 and 3 --

Column 9,
Line 8, delete "s" after "of"

Signed and Sealed this

Eighth Day of January, 2002

*Attest:*

*Attesting Officer*

JAMES E. ROGAN
*Director of the United States Patent and Trademark Office*